United States Patent [19]

Nerrinck et al.

[11] Patent Number: 5,003,711

[45] Date of Patent: Apr. 2, 1991

[54] ALPINE SKI BOOT

[75] Inventors: Bernard Nerrinck, La Balme-de-Sillingy; Maurice Bonnet, Rumilly, both of France

[73] Assignee: Salomon S.A., Annecy Cedex, France

[21] Appl. No.: 748,458

[22] Filed: Jun. 25, 1985

[30] Foreign Application Priority Data

Jul. 13, 1984 [FR] France ..... 84 12099

[51] Int. Cl.[5] ..... A43B 5/04

[52] U.S. Cl. ..... 36/120; 36/50; 36/117

[58] Field of Search ..... 36/117-121, 36/50; 24/68 SK, 69 SK, 70 SK, 71 SK, 68 CD, 68 CT, 69 ST, 69 CT, 70 CT, 70 ST, 71 CT

[56] References Cited

U.S. PATENT DOCUMENTS

| | | | |
|---|---|---|---|
| 3,545,106 | 12/1970 | Martin | 36/50 |
| 3,834,048 | 9/1974 | Maurer | 36/50 |
| 3,975,838 | 8/1976 | Martin | 36/121 |
| 4,008,532 | 2/1977 | Kilbourn et al. | 36/120 |
| 4,083,130 | 4/1978 | Bertetto et al. | 36/117 |
| 4,142,307 | 3/1979 | Martin | 36/50 |
| 4,190,970 | 3/1980 | Annovi | 36/50 |
| 4,196,530 | 4/1980 | Delery | 36/119 |
| 4,222,184 | 9/1980 | Kastinger | 36/121 |
| 4,360,979 | 11/1982 | Spademan | 36/121 |
| 4,480,403 | 10/1983 | Martin | 36/120 |
| 4,499,676 | 2/1985 | Chalmers, II | 36/120 |
| 4,519,149 | 5/1985 | Pozzobon | 36/121 |
| 4,539,763 | 9/1985 | Walkhoff | 36/120 |
| 4,593,483 | 6/1986 | Paris | 36/119 |

FOREIGN PATENT DOCUMENTS

| | | | |
|---|---|---|---|
| 0053340 | 6/1982 | European Pat. Off. | 36/117 |
| 0120268 | 10/1984 | European Pat. Off. | 36/117 |
| 2107659 | 9/1972 | Fed. Rep. of Germany . | |
| 2335679 | 4/1975 | Fed. Rep. of Germany . | |
| 2523744 | 1/1976 | Fed. Rep. of Germany . | |
| 3247516 | 6/1984 | Fed. Rep. of Germany . | |
| 3247516 | 6/1984 | Fed. Rep. of Germany . | |
| 3342121 | 6/1984 | Fed. Rep. of Germany . | |
| 3442780 | 6/1985 | Fed. Rep. of Germany . | |
| 3502522 | 8/1985 | Fed. Rep. of Germany . | |
| 3506057 | 2/1986 | Fed. Rep. of Germany . | |
| 2275166 | 1/1976 | France . | |
| 2448872 | 9/1980 | France . | |
| 2450575 | 10/1980 | France . | |
| 2536254 | 5/1984 | France . | |
| 2536965 | 6/1984 | France . | |
| 57-086301 | 5/1982 | Japan . | |
| 0549970 | 6/1974 | Switzerland . | |

*Primary Examiner*—Paul T. Sewell

*Attorney, Agent, or Firm*—Sandler, Greenblum & Bernstein

[57] ABSTRACT

A ski boot including an upper surrounding the lower leg of the skier, and a shell base for surrounding the foot of the skier. The boot also includes an apparatus for closing the upper on the lower leg of the skier, an apparatus for holding the foot in the boot, and a mobile linking device for linking the closing apparatus and the holding apparatus so that actuation of one of the holder and closing apparatus actuates the other of the holding and closing apparatus. The closing apparatus and the holding apparatus comprise first and second cables, respectively, and the mobile linking device is attached to a first portion of the boot. The mobile linking device includes at least one countershaft around which one of the first and second cables are at least partially wound to define a loop including first and second strands. The first strand is attached to the first portion of the boot and the second strand is attached to a second portion of the boot. In addition, the cable that is not wound around countershaft is attached to mobile linking element and to the second portion of the boot.

180 Claims, 12 Drawing Sheets

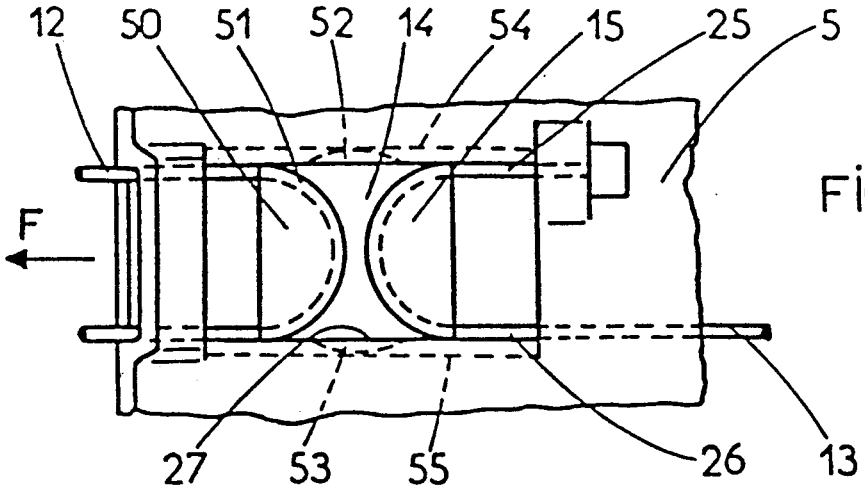
FIG. 5
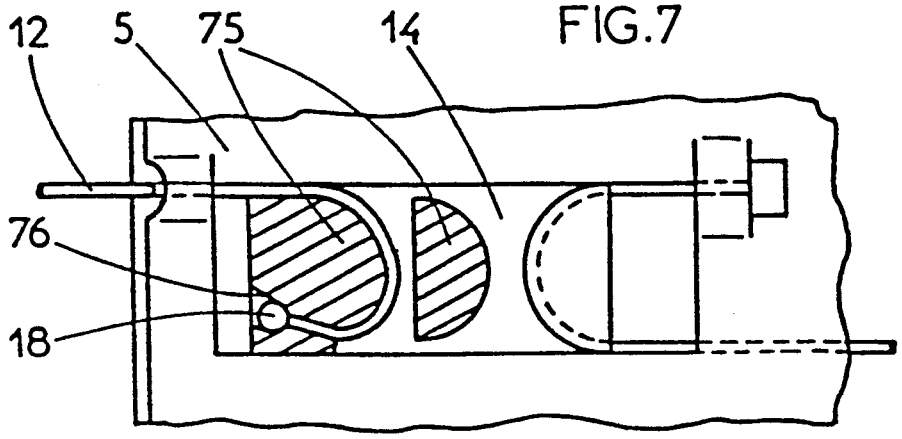
FIG. 7
FIG. 6
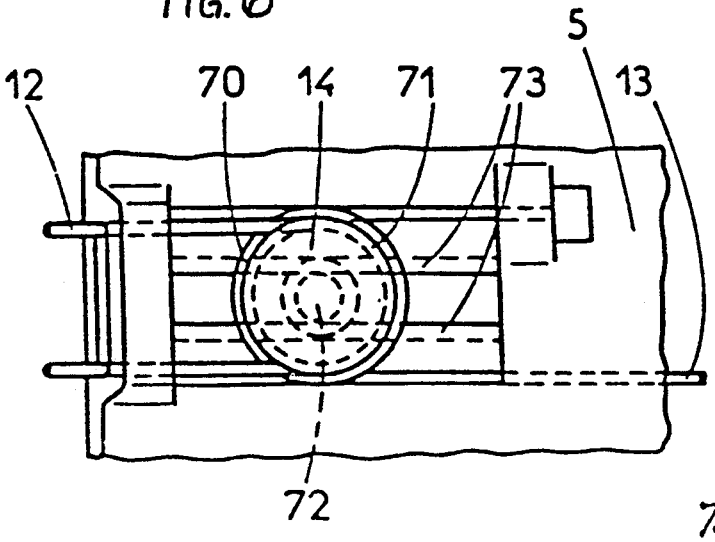
FIG. 6a
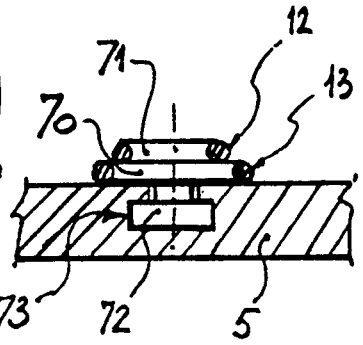

FIG.24
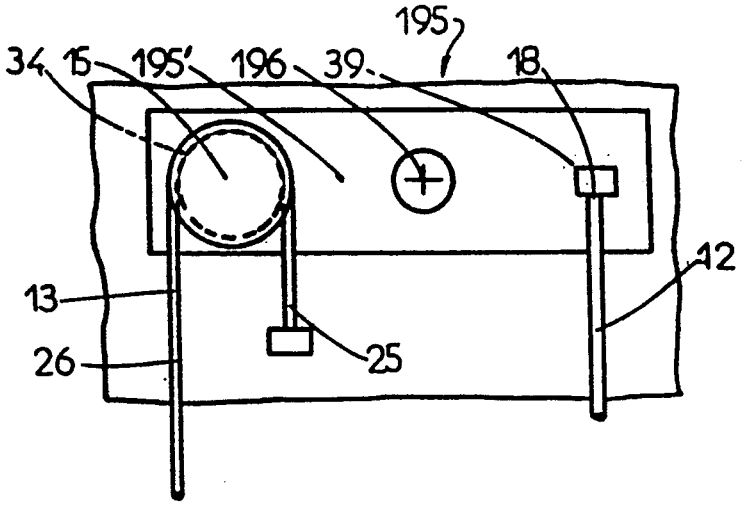
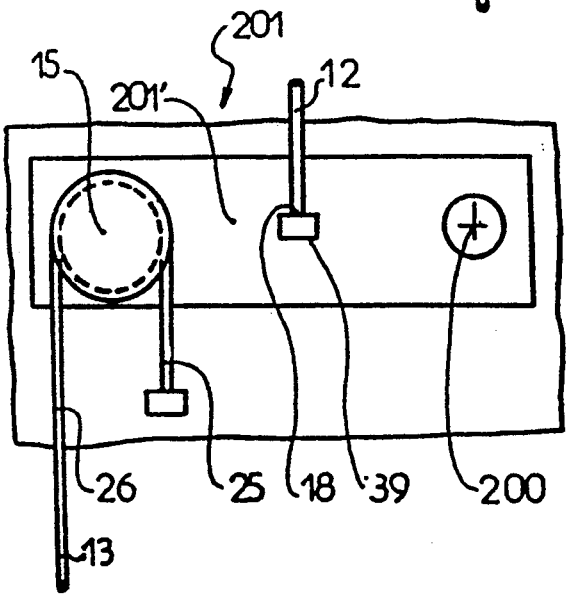
FIG.25
FIG. 26
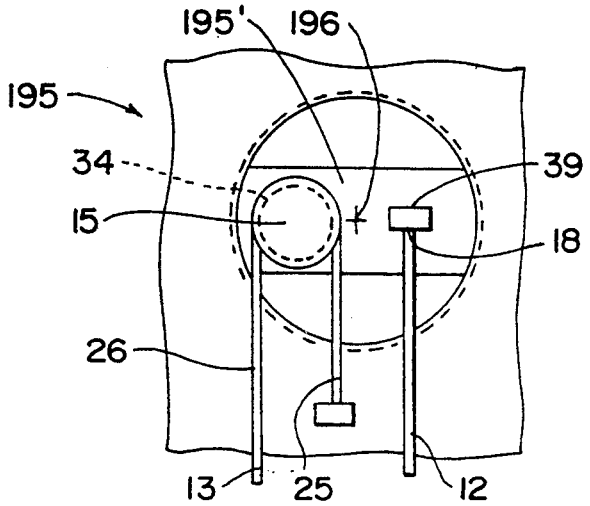

ALPINE SKI BOOT

BACKGROUND OF THE INVENTION

1. Field of the Invention

The present invention relates to ski boots and more particularly relates to devices which are attached to ski boots to hold down the foot of the skier in the boot and to close the boot on the leg of the skier.

2. Description of Background Information

Ski boots using hooks for closing the boot on the lower leg of the skier and for holding the foot of the boot are known in the art. In these types of boots the hooks are spaced apart on the top of the foot and on the front of the lower leg. To obtain the desired amount of force for holding down the foot in the boot one adjusts the corresponding hooks by changing their respective positions. Although these types of boots distribute the forces relatively well between the lower leg, and the foot, the manipulation of the hooks is time consuming and difficult. In addition, these types of boots are difficult to adjust, they are costly to produce, and the hooks protrude from the top of the boot thus producing the risk that the hooks will snag while skiing.

Other types of boots replace the hooks for holding down the foot with a cable system adapted to be put under pressure by a device that can be hidden in the back of the boot above the heel. In this type of boot the foot enters the boot from the rear and the closing of the upper of the boot on the lower leg is obtained by means of another hold down device having one hook. As a result, the adjustment of the holding down of the foot and the closing of the upper on the lower leg is simplified because the skier only manipulates two maneuvering parts. Nevertheless, each maneuvering part must be equipped with a specific adjusting device which increases the number of parts to be manipulated, thereby increasing the cost of the boot which is always excessively high.

This problem of an excessive number of manipulation elements has been solved by German Patent No. 25 23 744 which discloses a ski boot having a single means for holding down the foot and closing the upper on the lower leg. However, although the closing device described in this patent permits the simultaneous holding down of the foot and the closing of the upper on the lower leg of the skier, it does so by using a complex arrangement of elements which is costly to produce.

Thus, there is a need for a means for holding down the foot and closing the upper on skier's lower leg that is simple in construction and which causes these two actions to occur by the manipulation of one element. Further, there is a need for a ski boot that holds down the foot of the skier in response to closing of the upper on the lower leg, and which closes the upper on the lower leg of the skier in response to holding the foot down in the boot.

SUMMARY OF THE INVENTION

It is an object of the present invention to provide means for holding down the skier's foot in the boot and for closing the upper on the lower leg of the skier that is simple in construction and which causes these two actions to occur by the manipulation of one element.

It is another object of the present invention to provide a ski boot which closes the upper on the lower leg of the skier in response to holding down the foot in the boot and which holds down the foot in the boot in response to closing the upper on the lower leg of the skier.

One embodiment of the present invention which achieves these objectives relates to a ski boot for holding the foot and lower leg of a skier. The boot comprises an upper surrounding the lower leg of the skier, means for closing the upper on the lower leg of the skier, means for holding the foot of the skier in the boot, and means for linking the closing and holding means. The linking means comprises means for actuating one of the closing and holding means in response to actuation of the other of the closing and holding means.

The boot further comprises a shell base surrounding the foot of the skier. The upper extends from the top of the shell base. The upper is journalled on the shell base. In addition, the closing means can comprises a first traction element and means for tensioning the first traction element. The first traction element closes the upper on the lower leg in response to tensioning of the first traction element by the tensioning means.

In one embodiment the first traction element at least partially surrounds the circumference of the upper. Also, the holding means can comprises a second traction element for applying a force to hold the foot in the boot In this embodiment the linking means links the first and second traction elements.

The boot can also comprises first and second portions. At least one of the first and second portions is adapted to be displaced to close the upper on the lower leg of the skier. In this embodiment the linking means comprises a mobile linking device. The mobile linking device is attached to the first portion of the boot. The mobile linking device comprises at least one countershaft around which one of the first and second traction elements is at least partially wound to define a loop comprising first and second strands. The first strand is attached to the first portion of the boot at a distance from the mobile linking device and the second strand is attached to the second portion of the boot.

The other of the first and second traction elements is attached to the mobile linking device and to the second portion of the boot. At least one of the first and second portions of the boot is adapted to be displaced with respect to the other of the first and second portions so as to occupy open and closed positions. In the open position, the boot is adapted to receive the leg and foot therein. In the closed position, the upper is closed on the lower leg of the skier. In this embodiment, the holding means further comprises a support adapted to be positioned on top of the foot. The second traction element engages the support so that the support applies a force to the foot in response to tensioning of the second traction element by displacement of the mobile linking device.

The tensioning means preferably comprises a lever journalled on the upper. The lever is journalled on the upper between the open and closed positions. The first traction element is tightened in response to displacement of the lever from the open to the closed position of the lever.

In one embodiment, the tensioning means further comprises a screw and a plug attached to the screw. The first traction element is attached to the plug and the screw is rotatably attached to the lever. The plug and the first traction element are displaced in response to rotation of the screw. In this embodiment, the first portion of the boot can comprise a cuff and the second portion of the boot can comprise a spoiler adapted to pivot with respect to the cuff between open and closed positions. The spoiler comprises a rear portion on which the lever is journalled. The lever further comprises two lateral walls each having an opening therein. The first traction element extends through the openings and the plug is positioned between the two lateral walls. The first traction element can comprise a cable.

In an alternative embodiment, the boot further comprises means for adjusting the position of the mobile linking device. In this embodiment an end of the second traction element is attached to the adjusting means.

The mobile linking device, in one embodiment, comprises a plurality of spaced apart countershafts. In this embodiment the second traction element can comprise a cable adapted to be at least partially wound around each of the countershafts.

In still another embodiment, the second portion of the boot is adapted to be displaced to close the upper on the lower leg of the skier. In this embodiment the first and second strands are attached to the first and second portions of the boot at first and second attachment points, respectively. Also provided is means for adjusting the position of the first and second attachment points and means for adjusting the position of the other of the traction members on the first and second portions of the boot. The other of the traction members is attached to the first portion of the boot at a third attachment point and to the second portion of the boot at a fourth attachment point. In this embodiment the boot further comprises means for adjusting the position of the third and fourth attachment points.

In another embodiment, boot further comprises a lower portion and the holding means is positioned in the general vicinity of the foot and the lower portion of the boot. The holding means further comprises a support. The second traction element engages the support and is adapted to apply a force to the support. In turn, the support applies a force to the foot holding the foot down in the boot in response to the second traction element applying force to the support, which is positioned at substantially the vertical level of the top of the foot. Further, the mobile linking device preferably comprises the means for adjusting the position of the first and second strands.

The mobile linking device is adapted to be translationally or rotationally displaced. At least one of the first and second traction means comprises means for translationally or rotationally displacing the mobile linking device in at least one direction, or in a plurality of directions.

The boot can further comprise a wall and a housing positioned in or on the wall. The mobile linking device slidingly engages the housing. Also, the mobile linking device can further comprise a circular projection, and the housing can comprise a groove adapted to receive the circular projection. The length of the groove is longer than the diameter of the projection so that the circular projection slidingly engages the groove.

In still another embodiment the first portion of the boot comprises a cuff having a lateral wall. In this embodiment the housing in positioned in the lateral wall of the cuff.

In an alternative embodiment the first portion of the boot comprises a cuff comprising first and second lateral walls and the second portion of the boot comprises a spoiler. The shell base comprises a lower internal portion having a lateral wall opposite from the first lateral wall of the cuff. The first strand comprises an end and the second strand comprises an end. The end of the first strand is fixed on the first lateral wall of the cuff and the end of the second strand is positioned on the lateral wall of the shell base. In this embodiment the other of the first and second traction elements comprises a first end and a second end. The first end of the other of the first and second traction elements is attached to the mobile linking device and the second end of the other of the first and second traction elements is attached to the second lateral wall of the cuff.

In another embodiment the mobile linking device further comprises a plurality of spaced apart countershafts. Each countershaft is adapted to be attached to the second traction element at a different position on the mobile linking element. The second traction element is attached to the countershafts by being at least partially wound around one of the plurality of countershafts to define the loop comprising the first and second strands. In this embodiment the mobile linking device also comprises means for attaching the first traction element to the mobile linking device at an attachment point. The attaching means mentioned earlier comprises means for adjusting the position of the attachment point in this embodiment.

The attaching means can comprise a plurality of spaced apart anchors. Each anchor is adapted to attach the first traction element to the mobile linking device at a different position on the mobile linking device.

The mobile linking device can further comprise means for attaching the first traction element to the mobile linking device at an attachment point. The attaching means comprises means for adjusting the position of the attachment point. The adjusting means comprises a plurality of spaced apart plugs. Each plug is adapted to attach the first traction element to the mobile linking device at a different location on the mobile linking device. The first traction element is adapted to be attached to each of the plugs.

In addition the first traction element can comprise a first end, a second end, and an intermediate portion between the first and second ends. The first end has a diameter larger than the intermediate portion and one of the plugs comprises an opening therein having a first portion and a second portion. The first portion of the opening is sufficiently large to accommodate the first end of the first traction element. The second portion of the opening has a diameter smaller than the diameter of the first end of the first traction element and is sufficiently large to accommodate passage of the intermediate portion of the first traction element.

In still another embodiment, the mobile linking device further comprises a plurality of countershafts and means for attaching the second traction element to the mobile linking device at an attachment point. In this embodiment, the first traction element is adapted to be at least partially wound around each of the plurality of countershafts, and the attaching means comprises means for adjusting the position of the attachment point. Furthermore, the attaching means can also comprise a plurality of space apart anchors. Each anchor is adapted to attach the second traction element to the mobile linking device at a different position on the mobile linking device. Furthermore, the first portion of the boot in this embodiment comprises a cuff, and the second portion of the boot comprises a spoiler. The spoiler is adapted to be displaced between open and closed position with respect to the cuff.

In an alternative embodiment the first portion of the boot comprises the spoiler and the second portion of the boot comprises the cuff. In this embodiment the spoiler is also adapted to be displaced between the open and closed position with respect to the cuff.

The second traction element can comprise the first end which is attached to one of the anchors, and the first traction element can also comprise a first end which is fixed to the first portion of the boot; that is the portion of the boot to which the mobile linking device is attached.

In still another embodiment, the first traction element comprises a cable. This cable comprises a first end and a second end. In this embodiment, the second portion of the boot comprises a plurality of spaced apart attachment means for attaching the first end of the cable to the second portion of the boot. In addition, the second end of the cable is attached to the mobile linking device. Furthermore, the second portion of the boot can comprise a spoiler and the first portion can comprise a cuff. The spoiler is adapted to be displaced between open and close positions with respect to the cuff. Also, the spoiler comprises tensioning means for tensioning the cable to close the spoiler on the cuff. In this embodiment, the spoiler further comprises a plurality of notches. The tensioning means, in addition, comprises a lever comprising an axis pin around which the lever is adapted to pivot when this axis pin engages one of the notches on the spoiler.

In still another embodiment, the mobile linking device further comprises first and second countershafts. Each traction element is at least partially wound around a different countershaft, in this embodiment. Also, the mobile linking device further comprises means for changing the distance between the two countershafts. In this embodiment, each countershaft comprises a threaded opening. Also, the changing means comprises a screw. This screw comprises a first portion and a second portion. The first portion of the screw comprises a thread oriented in a first direction which engages the threaded opening in the first countershaft. The second portion of the screw comprises a thread oriented in the direction opposite from this first direction. The second portion of the screw engages the threaded opening in the second countershaft. The mobile linking device in this embodiment further comprises a control element engaging the screw between the first and second countershafts. The control element comprises means for displacing the first and second countershafts in opposite directions on the screw.

In still another embodiment, the mobile linking device further comprises a substantially circularly shaped element comprising first and second recesses. The first traction element engages the first recess and the second traction element engages the second recess. In addition, the substantially circularly shaped element can comprise a stepped cone pulley. In this embodiment, the first portion of the boot comprises a cuff. The cuff comprises a lateral wall having a housing therein in which the mobile linking device is positioned. The housing further comprises a groove. The stepped cone pulley comprises first and second stepped portions each comprising one of the recesses. The first stepped portion has a smaller diameter than the second stepped portion, and the first recess is substantially in the shape of a T and it engages the groove of the cuff. In addition, the shape of the groove corresponds to the shape of the first recess.

In still another embodiment, the first and second traction elements extend substantially in the same plane on the mobile linking device. In this embodiment, the mobile linking device is adapted to rotate about an axis substantially perpendicular to this plane. Furthermore, the mobile linking device further can comprise attaching means for attaching the other of the first and second traction elements to the mobile linking device. In this embodiment the axis around which the mobile linking device rotates is positioned between the at least one countershaft and its attaching means.

In this embodiment, the first and second traction elements are attached to the mobile linking device such that the first traction element comprises means for exerting a traction force on the mobile linking device in the same direction as the second traction element. Furthermore, the first and second strands of the traction element engaging the countershaft extend from the at least one countershaft in substantially the same direction as the direction in which the other of the first and second traction elements extends away from the mobile linking device.

In an alternative embodiment, the boot further comprises means for attaching the other of the first and second traction elements to the mobile linking device. In this embodiment, the attaching means is positioned between the at least one countershaft and the axis around which the mobile linking device pivots. Also, the first and second traction elements are attached to the mobile linking device such that the first traction element comprises means for exerting a traction force on the mobile linking device in a direction opposite from the direction in which the second traction element is adapted to exert a traction force on the mobile linking device.

In another embodiment, the boot further comprises a substantially circular housing for housing the mobile linking device. In this embodiment, the mobile linking device comprises a substantially circular element adapted to slide in the housing around an axis.

In still another embodiment, the foot of the skier comprises malleoli, and the shell base comprises a top portion. The first portion of the boot in this embodiment comprises the front cuff and the second portion of the boot comprises a rear spoiler. The front cuff extends upwardly from the top of the shell base. Furthermore, the rear spoiler is journalled on the shell base substantially at the malleoli of the skier. Also, the mobile linking device is positioned on a lateral side of the front cuff. Furthermore, this embodiment the boot further comprises means for adjusting the position of the mobile linking device. This adjusting means is attached to at least one of the traction elements.

The mobile linking device can be positioned on an internal surface of one lateral side of the cuff, or when the front cuff comprises a first and second lateral side, the mobile linking device can be attached to the first lateral side of the front of the cuff. In this latter embodiment the first traction element comprises first and second ends. The first end of the first traction element is attached to the mobile linking device, and the second end of the first traction element is attached to the second lateral side of the cuff at substantially the same vertical level as the attachment point of the first end to the mobile linking device.

In this embodiment, the holding means can further comprise a support which engages the second traction element. This support applies a force on the foot to hold the foot in the boot in response to tensioning of the second traction element. In this embodiment the boot also comprises a journal element around which the rear spoiler is journalled. The rear spoiler, in turn comprises an interior rear periphery having a groove therein. The second traction element also comprises in this embodiment first and second ends and an intermediate portion between the first and second ends. The first end of the second traction element is attached to the first lateral side of the front cuff and is spaced a predetermined distance from the mobile linking device. The intermediate portion of the second traction element engages the support and extends from the support to the journal element and extends into the groove. This second end is attached to the adjusting means. The adjusting means can comprise a roller around which the second traction element is wound in response to rotation of the roller.

In still another embodiment, the tensioning means can comprise a lever journalled on the rear spoiler. The lever comprises a first end comprising a journal element. The rear spoiler further comprises a plurality of notches. The journal element engages one of the notches when the lever is attached to the rear spoiler. In still another embodiment, the boot can comprise two mobile linking devices, each positioned on a different lateral side of the cuff.

In still another embodiment, one of the first and second portions of the boot comprises a front cuff and the other of the first and second portions of the boot comprise a rear spoiler journalled on the shell base. In this embodiment, the boot further comprises a means for adjusting the position of the mobile linking device. This adjusting means is attached to one of the traction elements. For example, the second traction element can be attached to the adjusting means and the adjusting means comprises a roller mounted on the rear spoiler. In an embodiment in which the tensioning means comprises a lever journalled on the rear spoiler, the adjusting means can be positioned below the lever on the rear spoiler. In an embodiment in which the lever comprises two spaced apart lateral arms the adjusting means is positioned can be between these lateral arms. Alternatively, the first traction element can be attached to the adjusting means, and the adjusting means can comprise a roller positioned on the rear spoiler in this embodiment.

In an embodiment in which the first traction element is attached to the adjusting means the first portion of the boot can comprise the front cuff and the second portion of the boot can comprise the rear spoiler. The front cuff in this embodiment comprises a first lateral side, a second lateral side, and an inside. The front cuff also comprises an opening therein. In this embodiment the mobile linking device is positioned on the first lateral side of the cuff. Also, the rear spoiler comprises first and second lateral sides and a rear portion between the first and second lateral sides. The rear portion of the spoiler also has an opening therein, and the spoiler further comprises first and second countershafts attached to the first and second laterals sides of the rear spoiler, respectively. In this embodiment, the tensioning means comprises a lever journalled on the rear portion of the rear spoiler. This lever comprises two spaced apart lateral arms. Each lateral arms has an opening therein. Also, the shell base and the rear spoiler comprise lower portions in this embodiment, and the lower portion of the rear spoiler comprises an opening therein. Further, the adjusting means is positioned between the lateral arms of the lever, and the first traction element comprises first and second ends and an intermediate portion between the first and second ends. The first end of the first traction element is attached to the mobile linking device. The intermediate portion of the first traction element extends from the first lateral side of the front cuff to the first countershaft of the rear spoiler, through openings in the lateral arms of the lever to the second countershaft of the rear spoiler, and through the opening in the front cuff so as to extend into the inside of the front cuff, and through the lower portion of the shell base, and then through the opening in the lower portion of the spoiler. The second end of the traction element is attached to the adjusting means.

In an alternative embodiment, in which the first traction element is attached to the adjusting means, the cuff can also comprise first and second lateral sides. The first lateral side of the cuff has an opening therein. Also, in this embodiment the mobile linking device is attached to the second lateral side of the cuff, and the rear spoiler comprises a rear portion comprising a heel portion at the bottom thereof and an opening above this heel portion. In addition, the rear spoiler further comprises two lateral sides, and first and second countershafts, each positioned on one lateral side of the rear spoiler. In this embodiment, the tensioning means comprises a lever journalled on the rear portion of rear spoiler. The lever comprises two spaced apart lateral arms, with the adjusting means positioned between the two spaced apart lateral arms of the lever. In this embodiment, the mobile linking device further comprises first and second countershafts. The second traction means engages the second countershaft on the mobile linking device. In this embodiment the first traction element comprises a first end, a second end, and an intermediate portion between the first and second ends. The first end of the first traction element is attached to the first lateral side of the cuff, and the second end of the first traction element is attached to the adjusting means. The intermediate portion engages the first and second countershafts of the rear spoiler. The intermediate portion is also attached to the lever and engages the first countershaft of the mobile linking device. Further, the intermediate portion extends through the openings in the first lateral side of the cuff, and in the rear portion of the spoiler above the heel portion.

In another alternative embodiment in which the first traction element is attached to the adjusting means, the holding means further comprises a support. In this embodiment the second traction element engages the support, and in turn the support applies a force to the foot to hold the foot in the boot in response to tensioning of the second traction element. In this embodiment, the rear spoiler is journalled on the shell base around a journal axis and the cuff comprises first and second lateral sides The first lateral side of cuff has an opening therein, and the mobile linking device is attached to the second lateral side of the cuff. Furthermore, the rear spoiler comprises a rear portion comprising a heel portion at the bottom thereof and an opening above the heel portion. In addition, the rear spoiler further comprises two lateral sides and first and second countershafts each positioned on a different lateral side of the rear spoiler. Furthermore, the tensioning means comprises a lever journalled on the rear portion of the rear spoiler. The lever comprises two spaced apart lateral arms, with the adjusting means positioned between the two spaced apart lateral arms of the lever. In this embodiment the first traction element comprises a first end, a second end, and an intermediate portion between the first and second ends. The first end is attached to the mobile linking device and the second end of the first traction element is attached to the adjusting means. The intermediate portion extends from the first end to engagement with the first countershaft of the rear spoiler, from the first countershaft of the rear spoiler to engagement with the lever, from the lever to engagement with the second countershaft on the rear spoiler, from the second countershaft of the rear spoiler through the opening in the cuff to engagement with the top of the support, from the support to the journal axis, from the journal axis to the heel of the spoiler, from the heel of the spoiler upwardly through the opening of the rear portion of the spoiler to the second end of the first traction element.

In still another embodiment having an adjusting means attached to one of the traction elements, the adjusting means is positioned on the closing means. In this embodiment, the adjusting means can comprise a roller engaging the first traction element, or the adjusting means can comprise a lever and a clamp engaging the first traction element, or the adjusting means can comprise a screw and a plug attached to the screw which engages the first traction element. Alternatively, the adjustment means engages the first end of the first traction element. Also, the rear spoiler in this embodiment can be journalled on the shell base, and the adjustment means can comprise a roller positioned on the rear spoiler.

In still another embodiment, the tensioning means comprises a locking and tensioning element and it also comprises spaced apart notches on the boot. Each notch is adapted to receive the locking and tensioning element therein. The locking and tensioning element and the notches comprise means for tensioning the first traction means by releasably locking the locking and tensioning element in each of the notches. The locking and tensioning element is attached to the first traction element in this embodiment. Also, the notches can comprise ratchet notches. In addition, the first portion of the boot in this embodiment can comprise a front cuff and the second portion of the boot can comprise a rear spoiler journalled in the shell base. In this embodiment, the front cuff comprises first and second lateral sides and a mobile linking device is attached to the first lateral side of the front cuff. The ratchet notches are attached to the second lateral side of the front cuff.

In this embodiment, the mobile linking device comprises a first countershaft engaging the first traction element and a second countershaft engaging the second traction element.

In still another embodiment, the first portion of the boot comprises a front cuff, the second portion of the boot comprises a rear spoiler. The closing means comprises a means for applying a force distributed symmetrically with respect to the longitudinally plane of symmetry of the boot on the front cuff and on the rear spoiler to close the upper on the lower leg of the skier.

In still another embodiment, the first portion of the boot comprises a front cuff and the second portion of boot comprises a rear spoiler. The front cuff comprises first and second lateral sides. The first lateral side comprises a top portion having an inner surface. The mobile linking device is positioned at the inner surface of the top portion of the first lateral side of the front cuff. The mobile linking device in this embodiment comprises first and second countershafts. The second countershaft engages the second traction element, and the first countershaft engages the first traction element. In this embodiment the first traction element further comprises first and second loops. The first loop attaches the first traction element to the first countershaft and the second loop attaches the second traction element to this second lateral side of the front cuff. In addition, the boot can further comprise a second lateral side countershaft to which the first traction element is connected by the second loop. In this embodiment, the first countershaft of the mobile linking device and the second lateral side countershaft are positioned symmetrically with respect to the longitudinal plane of symmetry of the boot.

Also, the rear spoiler in this embodiment can comprise a rear portion having first and second lateral sides. The first lateral side of the rear portion of the rear spoiler comprises a first countershaft and the second lateral side of the rear portion of the rear spoiler comprises a second countershaft. The tensioning means comprises a lever journaled on the rear spoiler, and the lever comprises a plurality of spaced apart notches. Each notch is adapted to receive a portion of the first traction element. The first traction element extends from the first countershaft of the mobile linking device, around at least a portion of the first countershaft of the first lateral side of the rear portion of the rear spoiler to one of the plurality of notches. The first traction element then extends through one of the plurality of notches, around at least a portion of the second countershaft of the second lateral side of the rear portion of the rear spoiler to the countershaft of the second lateral side of the front cuff. The first traction element then extends at least partially around the countershaft of the second lateral side of the front cuff, around the rear portion of the rear spoiler to the first countershaft of the mobile linking device.

In still another embodiment, the first portion of the boot can comprise a front cuff and the second portion of the boot can comprise a rear spoiler journaled on the shell base around a journal axis between opened and closed positions. The front cuff comprises the first and second lateral sides, and the boot comprises first and second mobile linking devices positioned on the first and second lateral sides of the front cuff, respectively. In this embodiment, the shell base comprises first and second lateral sides, and the first and second mobile linking devices comprise first and second countershafts, respectively. The boot in this embodiment further comprises two second traction elements. Each of the second traction elements comprises a first end and a second end and an intermediate portion between the first and second ends. The first end of each second traction element is attached to a different lateral side of the cuff. The second end of each second traction element is attached to a different lateral side of the shell base at substantially the point of intersection between the journal axis and the shell base. In this embodiment, the holding means comprises a support. Also, the second traction element is adapted to engage the support. The support applies a force to the foot to hold the foot in the boot in response to tensioning of the second traction element. In this embodiment, the intermediate portion of the second traction elements are at least partially wound around a different countershaft of one of the mobile linking devices. Also, the intermediate portions of the second traction elements extend substantially diagonally over the top of the support in different directions.

In still another embodiment, the first portion of the boot comprises the upper and the second portion of the boot comprises the shell base, and in an alternative embodiment, the first traction element can comprise a buckle.

In still another alternative embodiment, the first portion of the boot can comprise the upper and the second portion of the boot can comprise the shell base. In this embodiment, the upper comprises first and second spaced apart portions adapted to be displaced between the opened and closed positions on the lower leg of the skier. In this embodiment, the first traction element comprises means for displacing the first and second portions together into the closed position. Also in this embodiment, the mobile linking device is positioned on the first portion of the upper, and the mobile linking device comprises a plurality spaced apart teeth. The second portion of the upper comprises the tensioning means and the first traction element is attached to this tensioning means. Also, the first traction element is adapted to engage each of the plurality of teeth. The first and second spaced apart portions of the upper are displaceable into their closed position in response to tensioning of the first traction element by the tensioning means when the first traction element engages one of the teeth.

In this embodiment, the first traction element can comprise a buckle and the second tensioning means can comprise a lever attached to the buckle and a clamp journalled on the lever. The clamp is adapted to be displaced between opened and closed positions. The clamp tensions the first traction element in the closed position. The buckle closes the first and second portions of the upper when the buckle engages one of the teeth in response to displacing the clamp into the closed position Also, the shell base can comprise first and second spaced apart portions in this embodiment. The first and second spaced apart portions of the shell base are also adapted to be displaced between an opened position and a closed position. In the closed position of the shell base the first and second portions of the shell base are closer together than in the open position of the shell base. In the closed position of the shell base the first and second portions of the shell base can exert a force on the foot to hold the foot in the shell base. Furthermore, in this embodiment, the first traction element comprises a cable having a first end and a second end and an intermediate portion between the first and second ends. The first end is attached to the first portion of the upper. Also, a portion of the intermediate portion of the first traction element is at least partially wound around the at least one countershaft of the mobile linking device. Another portion of the intermediate portion is attached to the first and second portions of the shell base. The second end of the cable is attached to one of the first and second portions of the shell base. The second traction element closes the shell base in response to tensioning of the first traction element.

In still another embodiment the shell base is rigid and comprises malleoli. The upper and the shell base also comprise a front portion having an opening therein. Furthermore, the upper is journaled on the shell base at substantially the position of the malleoli. In addition, the upper comprises a collar and the upper extends upwardly from the top of the shell base. The collar comprises a covering comprising two straps. The mobile linking device is positioned on one of the straps. The boot further comprises in this embodiment means for adjusting the position of the mobile linking device. This adjusting means is attached to at least one of the traction element.

In still another embodiment, the first portion of the boot can comprise the rear spoiler. The rear spoiler is journaled on the shell base at the level of the malleoli of the skier's foot and the boot further comprises a front cuff. The cuff comprises means for flexing and the rear spoiler comprises a rear surface. The mobile linking device is positioned on the rear surface of the rear spoiler, and the boot further comprises means for adjusting the position of the mobile linking device. This adjusting means is attached to at least one of the traction elements.

In an alternative embodiment in which the first portion of the boot comprises the rear spoiler, the boot further comprises means for journaling the rear spoiler on the shell base. In addition, the second traction element in this embodiment is at least partially would on the at least one countershaft. Also, the first strand comprises an end. This end of the first strand is positioned on the rear spoiler. Also, the second strand can comprise an end in this embodiment and the second portion of the boot can comprise the journaling means. The end of the second strand is attached to this journaling means.

In this embodiment, the holding means comprises a support plate adapted to engage the top of the foot. Also, in this embodiment, the shell base and rear spoiler comprise first and second lateral sides. Also in this embodiment the journaling comprises a first portion positioned on the first lateral side of the shell base and rear spoiler, and a second portion positioned on the second lateral side of the shell base and rear spoiler. Also, the second strand further comprises an intermediate portion adjacent the end of the second strand. This intermediate portion contacts the top of the support plate and engages the first portion of the journaling means and the end of the second strand is attached to the second portion of the journaling means.

Also, in this embodiment the rear spoiler can further comprise a plurality of notches. Each notch comprises means for engaging the end of the first strand. In addition, in this embodiment the tensioning means is attached to the mobile linking element and this tensioning means comprises a lever journaled on the rear spoiler. The boot can further comprise a front cuff having first and second lateral sides. The first traction element comprises first and second ends and an intermediate portion between the first and second ends. The first and second ends of the first traction element are attached to the first and second lateral sides of the front cuff respectively, and the intermediate portion of the first traction element is attached to the lever.

In still another alternative embodiment in which the first portion of the boot comprises the rear spoiler, the tensioning means is attached to the mobile linking device, and the second traction element is at least partially wound around the at least one countershaft. The holding means further comprises a support plate and a cable. The support plate slidingly engages the rear spoiler. The first strand comprises an end and the second strand comprises an end. The end of the first strand is attached to the rear spoiler at a distance spaced from the mobile linking device and the end of the second strand is attached to the support plate. The cable is attached to the support plate and extends inside the shell base and is adapted to be positioned over the foot.

In this embodiment the boot can further comprise journaling means having first and second portions for journaling the rear spoiler on the shell base. In this embodiment the rear spoiler and the shell base comprise two lateral sides. One portion of the journaling means is attached to each lateral side of the rear spoiler and the shell base. In this embodiment the holding means further comprises a support adapted to be positioned over the foot in the shell base. Also, the shell base comprises a heel portion. This heel portion comprises two openings therein. In addition, the support plate comprises a countershaft. The cable extends around a portion of the countershaft of the support plate to form two strands. Each strand extends through a different opening in the heel of the shell base and engages a different portion of the journal means, and the top of the support.

In this embodiment, the boot can further comprise a front cuff having first and second lateral sides. The first traction element comprises in this embodiment first and second ends and an intermediate portion between the first and second ends. The first and second ends of the first traction element are attached to the first and second lateral sides of the front cuff respectively, and the intermediate portion of the first traction element engages the tensioning means.

In still another embodiment the boot further comprises means for adjusting the position of the mobile linking element. In this embodiment the adjusting means is attached to the first traction element. Furthermore, the adjusting means comprises a roller such that rotation of the roller displaces the first traction element. Also, the first portion of the boot can comprise the front cuff. In this embodiment the boot further comprises a rear spoiler journaled on the shell base. The rear spoiler comprises a rear portion The tensioning means comprises a lever journaled on this rear portion of the rear spoiler, and the roller is positioned on the lever. In this embodiment the holding means further comprises a support adapted to be positioned over the foot. The second traction means is partially wound around the at least one countershaft on the mobile linking device, and the second traction element comprises a first end and a second end, and an intermediate portion between the first and second ends. The first end of the second traction element is spaced from the mobile linking device and is attached to the front cuff, and the intermediate portion engages the top of the support.

Furthermore, in this embodiment the rear spoiler is journaled on the shell base around a journal axis, and the second end of the second traction element is attached to the shell base at this journal axis. Furthermore, the second portion of the boot can comprise the rear spoiler. The second end of the second traction element is attached to the rear portion of the rear spoiler below the lever. In an alternative embodiment in which the holding means comprises a support, the first traction element comprises a first and second end and an intermediate portion between the first and second ends. The front cuff, in turn, comprises first and a second lateral sides. The mobile linking device is attached to the first lateral side of the front cuff and the first end of the first traction element is attached to the mobile linking device. In this embodiment the second end of the first traction element is attached to the second lateral side of the cuff, and the intermediate portion of the first traction element is attached to the lever.

In still another embodiment, the boot further comprises a displaceable front cuff. In this embodiment the second traction means comprises means for displacing the front cuff to apply a force to the foot to hold the foot in the boot. In this embodiment the cuff is translationally displaceable. The first portion of the boot comprises in this embodiment a rear spoiler and the second portion of the boot comprises the displaceable front cuff. Furthermore, the boot further comprises in this embodiment a cable attached to the front cuff. The boot further comprises a displaceable attaching means for attaching the cable to the second traction means so that displacement of the mobile linking device displaces the displaceable attaching means and the cable, and translationally displaces the front cuff. In this embodiment the rear spoiler is journaled on the shell base and the rear spoiler comprises a rear portion. The mobile linking device, the tensioning means, and the attaching means are positioned on this rear portion of the rear spoiler. Furthermore, the tensioning means is attached to the mobile linking device and the second traction element is partially wound the at least one countershaft of the mobile linking device. Furthermore, the first strand is attached to the rear spoiler at a distance from the mobile linking device, and the second strand is attached to the attaching means, whereby the attaching means attaches the second strand to the front cuff.

In still another embodiment, the first portion of the boot to which the mobile linking device is attached comprises the shell base. In this embodiment the shell base comprises the lateral wall. The mobile linking device is positioned on this lateral wall on the shell base. In this embodiment the boot further comprises a rear spoiler journaled on the shell base. The tensioning means is positioned on the rear spoiler and the first traction element is attached to the mobile linking device and to the tensioning means. In addition, the rear spoiler is journalled on the shell base substantially at the malleoli of the foot of the skier. Furthermore, the holding means comprises a support plate adapted to be positioned above the foot in the boot. In this embodiment the second traction element engages the support plate, and the support plate applies a force to hold the foot in the boot in response to tensioning the second traction element. Also, the second portion of the boot comprises the front cuff. Furthermore, the second traction element is at least partially wound one the at least one countershaft of the mobile linking device. Furthermore, the first strand is attached to the shell base and the second strand is attached to the front cuff. In this embodiment the boot further comprises means for adjusting the position of the mobile linking device. The adjusting means is attached to at least one of the traction elements.

In still another embodiment, the holding means further comprises a support plate having a shape corresponding substantially to the shape of the top of the foot. Furthermore, the support plate is positioned in the shell base and engages to the second traction element.

In still another embodiment the first and second traction elements comprise first and second cables respectively. A portion of the first and second cables in encased in the boot.

In still another embodiment the invention relates to an apparatus for use with means for closing the upper of a boot on the lower leg of the skier and means for holding the foot of a skier in a boot. The apparatus comprises a mobile linking device adapted to be attached to the boot. The mobile linking device links the closing means with the holding means. Furthermore, the mobile linking device comprises means for actuating one of the closing and holding means in response to actuation of one of the other closing and holding means. In this embodiment the mobile linking device has all the characteristics and features of the mobile linking device discussed above with respect to all the embodiments of the boot.

In still another embodiment, the invention relates to an apparatus for closing the upper of a ski boot on the lower leg of a skier and for holding the foot of the skier in a shell base of the boot. The apparatus comprises means for closing the upper on the lower leg of the skier, means for holding the foot in the boot, and means for linking the closing and holding means. The linking means comprises means for actuating one of the closing and holding means in response to actuation of the other of the closing and holding means. This apparatus includes all the characteristics and features of the closing means, the holding means, and the mobile linking device discussed above in the discussion of all of the embodiment relating to the boot.

BRIEF DESCRIPTION OF THE DRAWINGS

The present invention and the mobile linking device of the present invention will be better understood upon referring to the detailed description which follows and to the attached drawings which illustrate various non-limiting examples of the preferred embodiments cf the present invention, in which:

FIGS. 5, 6, and 7 illustrate schematic views of various alternative embodiments of the mobile linking device;

FIG. 6*a* illustrates a schematic sectional view of the invention illustrated in FIG. 6;

FIGS. 24–26 illustrate schematic views of three alternative embodiments of the mobile linking device in which the mobile linking device is adapted for rotational movement around an axis in response to traction from the cable for closing the upper on the lower leg of the ski.

DETAILED DESCRIPTION OF PREFERRED EMBODIMENTS

Figure 1:
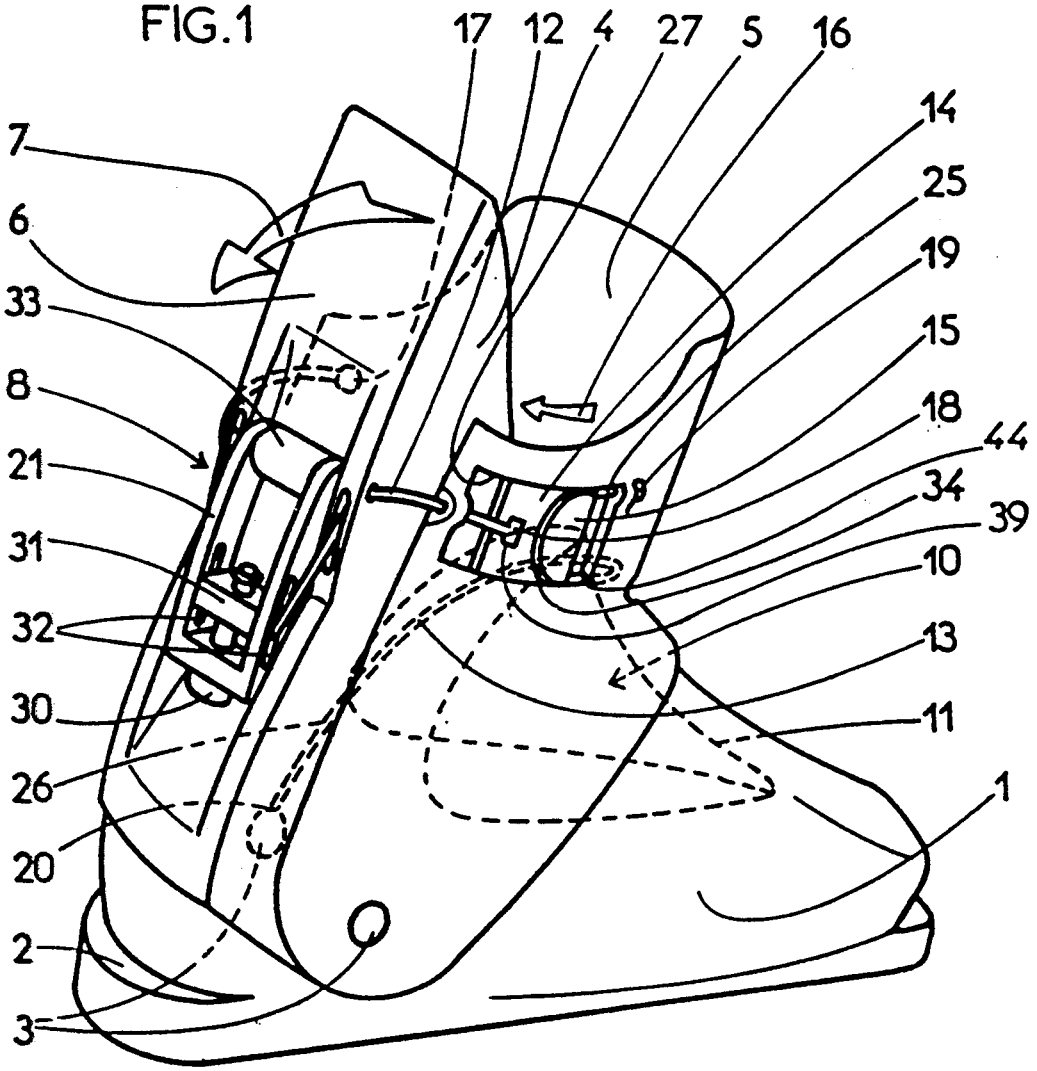
FIG. 1 illustrates a perspective view of a first embodiment of the present invention as applied to a ski boot.

As will be evident from the above description the apparatus of the present invention permits the automatic distribution of forces between the upper of the boot (and therefore on the lower leg of the skier) and the shell base so as to simultaneously close the upper on the lower leg of the skier and so as to hold the foot down in the shell base by manipulating only one element to close the upper on the leg of the skier.

According to one preferred embodiment the force distributing device of the present invention is attached to a rear-entry type ski boot which can be closed by means of the displacement of at least one flexible element. In one embodiment this element is a cable. This cable is actuated and tensioned by means of a single manipulation element. This type of boot is composed of relatively rigid elements, at least one of which is journaled on one of the other elements at certain points The tightening of the upper on the lower leg of the skier is performed by displacing a rear element of the upper, called a "spoiler", closer to the forward support of the upper, which is called a front "cuff". The holding down of the foot in these types of boots is preferably accomplished by means of a system for holding down the foot positioned on the inside of the boot. This system comprises, in a manner known in the art, a plate having an anatomical shape substantially corresponding to the shape of the foot. This plate is adapted to be placed under pressure so as to press the foot into the boot. The plate is placed under pressure by means of another flexible element, which can comprise a cable, a band, etc., in addition to the flexible element that tightens the upper on the lower leg of the skier. The present invention bifurcates the functions of the tightening of the upper on the lower leg of the skier and holding down the foot in the boot by providing separate elements for performing each of these functions. In addition, the means that perform these separate functions are actuated, advantageously, by the manipulation of one element by the skier when the skier places his foot in the boot. This is accomplished so as to achieve an optimal holding down of the foot within the boot in a manner that is at the same time comfortable to the skier.

According to the present invention the means designed to permit a single maneuver by the skier to perform both functions discussed above, comprises a device which is inserted between the two tightening cables associated with the tightening of upper on the lower leg and the tightening of the foot in the boot. This device acts as a mobile linking device which links the two cables in such a manner that by pulling one of the cable so as to perform one of the two functions discussed above, the other cable is simultaneously pulled and thereby performs the other function designed by the boot. Additionally, in order to distribute the forces of one cable on the other cable a countershaft is secured on the device linking the two cables. It should be noted that as used in the present application the term "countershaft" refers to any element, not necessarily in the shape of a shaft, around a portion of which one of the cables is adapted to extend so that the direction in which the cable extends before the cable reaches the countershaft is different from the direction in which the cable extends after the cable leaves the countershaft.

Thus, the cable for holding down the foot in the boot, for example, can engage the countershaft. This cable extends around at least a portion of this countershaft so that this cable comprises two strands. The cable engages the countershaft in such a manner that only one of the strands is adapted to actuate the system for holding down the foot in the boot. The other strand of this cable is preferably fastened to a fixed part of the boot, the cuff for example.

Another cable is designed to ensure the closing of the upper of the boot on the lower leg of the skier by bringing the spoiler and cuff closer together. One end of this cable is attached to an anchoring point secured on the mobile linking device. From the mobile linking device this cable extends at least partially around the upper part of the upper so as to cooperate with a tensioning element which is adapted to move between open and close positions. When this tensioning element is moved into its closed position this cable is tensioned, thereby bringing the spoiler and cuff closer together. The other end of this cable is anchored to any of the other parts of the boot, as long as a portion of the cable contacts the spoiler. Consequently, the force bringing the spoiler closer to the cuff is communicated directly to the mobile linking device, which then functions as a pulley to distribute this force equally on the two strands of the cable for holding down the foot. Only one of the strands actually actuates the system for holding the foot down by pressing the plate on the foot. As a result of this distribution of the forces between the two strands, the initial closing force produced by the cable for closing the spoiler on the cuff is reduced by half when this force is distributed on each of the strands on the cable for holding down the foot in the boot. Furthermore, by using such a distributing device, the displacement of one or the other of the cables can be reduced or multiplied according to the cable being considered, in reverse proportion to the original force applied to one of the cables. This aspect of the invention is advantageous in that it permits, depending upon the cable circuits effected, the automatic compensation for variations in the short perimeter of the heel and variations in the perimeter of the lower leg of various skiers. This compensation occurs by virtue of the various positions that the mobile linking device is capable of occupying, depending upon the different short perimeters of the heel and the different perimeters of the lower legs of various skiers. Furthermore, means can be provided for pre-adjusting the position of the mobile linking device by the skier so as to accommodate skiers having different short perimeters of the heel and different lower leg perimeters. Further, this pre-adjustment of the position of the mobile linking device also permits the skier to adjust, in advance the forced holding down the foot in the boot.

Thus, for example, in one embodiment the mobile linking device can also comprise several attaching means positioned across from or opposite from the countershaft. In the embodiment in which the cable for holding down the foot engages the countershaft these attaching means are adapted to receive an end of the other cable for closing the boot on the lower leg of the skier. By attaching the cable for closing the upper on different attaching means the effective length of the cable for holding down the foot can be adjusted so as to accommodate the morphologies of different skiers. In an alternative embodiment the mobile linking device can include a plurality of countershafts, each countershaft being adapted to engage the cable for holding down the foot in the boot. By attaching this cable to different countershafts, the skier can adjust the effective length of the cable for holding down the foot inside the boot.

In still another embodiment, the mobile linking device can comprise two attaching portions. Each attaching portion is adapted to attach one of the cable to the mobile linking device. The position of the cables is translationally adjustable with respect to each other, by means of a threaded screw, each end of which is screwed into one of the two attaching portions of the mobile linking device. Because each end of the screw is threaded in a different direction, when the screw is rotated the two attaching portions of the mobile linking device will be translationally displaced in opposite directions. Also provided is a control roller which is integral with the screw and is positioned between the two attaching parts of the mobile linking device. Preferably, this control roller is positioned substantially at the center of the screw along the length thereof. Rotation of the command roller by the skier rotates the screw, thereby screwing or unscrewing the screw in the two attaching portions of the mobile linking device.

In another embodiment, the adjustment of the effective lengths of the cables for holding down the foot or for tightening the upper on the lower leg of the skier can be performed by means of a ratchet or by a series of attaching means positioned on the portion of the boot, for example, the shell base, the cuff, or the spoiler. In such an embodiment, the end of the cable or a portion of the cable engages this attaching means, which can comprise an anchor. Moreover, the element or parts of the boot which act upon the cable, (for example hooks, rollers, levers, or countershafts) are preferably associated with the boot and receive at least one of the ends of the cables to adjust the effective lengths of at least one of these cables.

According to another embodiment of the mobile linking device, the cable which tensions the upper to close on the lower leg of the skier is looped around the countershaft. In this embodiment, one of the strands of the cable is adapted to be tensioned by the tensioning device discussed earlier while the other strand is attached to the boot at a distance from the countershaft, but not on the mobile linking device.

In this embodiment, one of the strands can partially extend around the lower leg so as to contact the spoiler, while the other strand, which is adapted to be tensioned by the tensioning means, can also partially surround the lower leg of the skier. In order to obtain a symmetrical holding down of the foot in the boot, two mobile linking devices and force distributors are positioned respectively on each side of the cuff. In this embodiment means are provided for controlling the closure on the upper on the lower leg of the skier. This control means comprises a single manipulation element which actuates the closing the upper on the lower leg of the skier. The cable for transmitting the force produced by the control means is attached to this control means. In one embodiment the control means can be a lever for tensioning this cable.

In still another embodiment in which there is also a symmetrical holding down of the foot in the boot, the mobile linking device can be positioned on the spoiler instead of the cuff. In this embodiment one end of the cable for holding down the foot is attached on the shell base on one side of the system for holding down the foot in the boot. This cable at least partially surrounds the plate having a shape substantially the same as the anatomical shape of the foot; this cable then returns to be anchored on the shell base at a point on the other side of the shell base at a point symmetrical with respect to the other attachment point of the cable to the shell base. Both of these points are symmetrical with respect to the longitudinal plane of symmetry of the boot. This cable is then guided by means which are known to those skilled in the art at the level at the heel, where the cable exits the inside of the boot. At the heel of the boot the cable passes through an opening therein so as to extend to the outside of the boot, and the cable is then looped around the countershaft of the mobile linking device. After passing around the countershaft of the mobile linking device the cable is fixed at one end in a notch provided on the rear spoiler. In this embodiment, the cable for tensioning the upper on the lower leg of the skier comprises two ends, each of which is attached on opposite sides of the cuff. Furthermore, this cable contacts and partially surrounds the spoiler and is attached to a tensioning means integral with the mobile linking device. This tightening means is positioned across from and/or opposite from the countershaft around which the cable for holding down the foot is looped. Thus, when the tensioning means is closed so as to come to rest on the rear spoiler, the cable to which this tensioning means is attached is tensioned and therefore because this cable is attached to the cuff, this tensioning means causes the displacement of these two parts of the upper toward each other. Because the force created by the tensioning means is transmitted simultaneously from the tensioning means to the mobile linking device upon which it is positioned, the mobile linking device is displaced. This displacement of the mobile linking device is transmitted to the countershaft around which the cable for holding down the foot is looped by means of another cable. Thus, displacement of the mobile linking device displaces the countershaft around which the cable for holding down the foot is looped, thereby tensioning the strand of this cable which engages the anatomical plate, thereby pressing the foot down into the boot.

According to another preferred embodiment of the present invention, the cable for holding down the foot can be in the form of a closed loop which partially surrounds the plate of the system for holding down the foot. In addition, the closed loop is adapted to be guided on each side of the boot by a series of hooks or attaching means which are independent of the mobile linking device. However, at least one of these hooks is linked to the mobile linking device by an element such as a cable which is attached to the countershaft of the mobile linking device and which is also attached to the spoiler at a distance from the mobile linking device, for example. In this embodiment, tension from the cable for closing the upper on the lower leg of the skier is transmitted by the mobile linking device to the two strands of the cable which extends partially around the countershaft. Only one of these two strands pulls on the cable for holding down the foot. As a result, the force necessary for closing the upper on the lower leg of the skier is twice that of the force used to hold down the foot in the boot. Of course, it is within the scope of the present invention to form the cable holding the foot down in the boot by two strands which are linked to each other by means of an element which partially surrounds the plate of the system for holding down the foot in the boot.

Furthermore, it is within the scope of the present invention to provide a housing or grooves in the boot for receiving the mobile linking device so that the mobile linking device can be more effectively guided during its displacement with respect to the boot. This housing can be integral with elements affixed to the boot, or the housing can be positioned within the thickness of a wall of the boot.

In addition it is also within the scope of the present invention to use any other means for adjusting the length of either of the cables. Such an adjusting means can be associated with the mobile linking device as well as any other portion of the boot. In addition, such an adjusting means can be designed to act upon at least one of the ends of the cables, or upon any portion of either of the cables.

It should be noted that in the description which follows the mobile linking device of the present invention is associated with ski boots having a "rigid shell" for which the primary constituent parts will be referred to by the same reference numerals.

As illustrated in FIG. 1, such boots conventionally comprise a rigid shell base 1 having a sole 2 upon which an upper 4 is supported. Upper 4 comprises a front support 5 known as a "cuff" and a rear support 6 which is known as a "rear spoiler". Rear spoiler 6 is journalled around a horizontal transverse axis 3 passing through journaling means 3. Reference numeral 3 is used to designate both the journaling means and the journal axis passing through the journaling means. Journal axis 3 is positioned substantially at the malleoli of the foot of the skier. Cuff 5 can be rigidly fastened to shell base 1 or, alternatively, cuff 5 can be journalled on shell base 1 around transverse axis 3 so as to provide a desired degree of flexibility of cuff 5 for the skier.

This type of boot is a rear-entry type of ski boot in which the entry of the foot into the boot occurs from the rear towards the front after having journalled spoiler 6 in the direction of arrow 7 seen in FIG. 1. More precisely, spoiler 6 is adapted to be positioned in an open position in which spoiler 6 is spaced apart from cuff 5 in the direction of arrow 7 so as to receive the lower leg and the foot of the boot. In addition, spoiler 6 is also adapted to be journalled from its open position into its closed position in which spoiler 6 is closed upon cuff 5 and against the lower leg of the skier. This closed position of spoiler 6 is illustrated in FIG. 1.

The adapting of the boot to the foot of the skier is implemented with the aid of a system 10, inside the boot, for maintaining and holding the foot down inside of the boot. This system 10 comprises plate 11 having substantially the anatomical shape of the top of the foot to hold the foot down in the boot. System 10 further comprises a cable 13 for tensioning plate 11 so as to press plate 11 against the front of the foot. The apparatus of the present invention also comprises means 8 for closing the upper on the lower leg of the skier. Closing means 8 comprises a cable 12 and a tensioning or stretching lever 21 for tensioning and/or stretching cable 12 to close the upper on the lower leg of the skier. Cable 12 has ends 17 and 18 and means for anchoring ends 17 and 18 on cuff 5. One of these anchoring means is attached to a mobile linking device 14. Cable 13 also comprises two ends: 19 and 20. End 19 is attached to the lateral upper portion of cuff 5 while end 20 is attached to the lower internal portion of shell base 1 on the lateral side of shell base opposite to the lateral side of the boot to which mobile linking device 14 is attached.

Cable 13 forms a loop 34 around a countershaft 15 positioned on mobile linking device 14. As used in this text, the term "countershaft" refers to any element, of any shape whatsoever, which engages another element in such a manner that this other element extends in two different directions away from the countershaft.

Loop 34 comprises strands 25 and 26. Strand 26 extends through a wall of cuff 5. The portion of the wall through which strand 26 passes comprises an opening or a guiding canal 44 located, for example, at the bottom or the back of a guiding housing 27 housing mobile linking device 14. The opening in the inside of the boot formed by canal 44 determines the upper support point of cable 13. Furthermore, cable 13 extends on the inside of the boot substantially to the zone of journal axis 3. The traction exerted on cable 13 causes at journal axis 3 and opening 44 an oblique indirect holding down of the foot against the internal inside face of the boot.

Also provided, as mentioned earlier, is a tensioning or stretcher means for tensioning and/or stretching cable 12 which controls system 10 for holding down the foot in the boot and which controls the means for closing the upper on the lower leg of the skier by acting simultaneously upon cables 12 and 13 which are linked kinematically to mobile linking device 14.

Mobile linking device 14, in one embodiment, is provided with an anchoring means 39 which anchors end 18 of cable 12 to mobile linking device 14. The other end 17 of cable 12 is integrally attached to the other lateral side of cuff 5. Furthermore, end 19 of strand 25 is anchored at an attachment point on cuff 5. In various alternative embodiments which will be discussed below the attachment points of ends 19 and 20 of cable 13 to the boot and the attachment points of ends 17 and 18 of cable 12 to the boot are adjustable by means of an adjustment means to be discussed below.

Due to the positioning of cables 12 and 13 on the boot and on the mobile linking device 14, any tension or force applied to one of cables 12 and/or 13 is simultaneously transmitted to the other cable, thereby causing the simultaneous displacement of spoiler 6 toward cuff 5 and the holding down of the foot in the boot by hold down system 10.

The tensioning of cable 12 is caused by the tensioning element or stretcher 21 which in the embodiment seen in FIG. 1 is journalled on the rear portion of rear spoiler 6. Tensioning element 21 is adapted to move from an open position in which tension element 21 is pivoted away from the rear portion of spoiler 6 to a closed position in the direction of arrow 7 in FIG. 1, in which the tensioning element 21 is pressed against the rear portion of the rear spoiler as illustrated in FIG. 1. The displacement of tensioning element 21, which as seen in FIG. 1 as in the form of a lever, pulls cable 12 in the direction of arrow 16, thereby also displacing mobile linking device 14 in the direction of arrow 16 as seen in FIG. 1. As a result of the displacement of mobile linking device 14 in the direction of the arrow 16, cable 13 is also pulled in this direction by mobile linking device 14.

Figure 2:
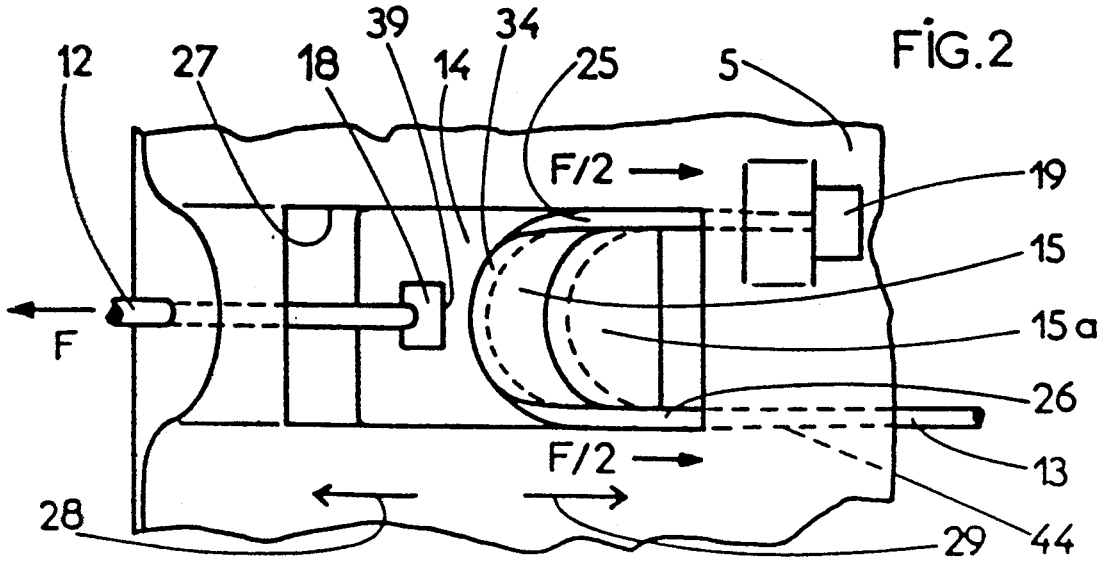
FIG. 2 illustrates in detail, a schematic view of the mobile linking device shown in FIG. 1 with the addition of several countershafts, wherein the mobile linking device links the different cables attached to the boot.

Due to the specific arrangement of the cables, the tensions and forces which are transmitted automatically from one cable to the other are not equal on the two cables. As illustrated in FIG. 2, if cable 12 experiences a tension or force F, this force F is transmitted by means of mobile linking device 14 to cable 13. However, this force F is distributed to the two strands of cable 13 such that each strand 25 and 26 which engages countershaft 15 experiences a force equal to F/2. Because end 19 of strand 25 is attached to cuff 5, as seen in FIG. 2, the force F/2 which is transmitted to cable 13 contributes to the closing of spoiler 6 against cuff 5. The force F/2 which is experienced by strand 26 of cable 13, on the other hand, exerts a force F/2 against plate 11 so as to hold the foot down in the boot, because strand 26 extends from countershaft 15 to plate 11. As a result, mobile linking device 14 transforms a single pivoting of lever 21 into two distinct forces for closing spoiler 6 against cuff 5 and holding down the foot in the boot, which occur simultaneously on upper 4 and on the inside of the boot against the foot.

Moreover, mobile linking device 14 also automatically and simultaneously changes the effective length cables 12 and 13 in such manner that the effective length of cables 12 and 13 varies in inverse proportion to the distribution of the forces which respect to these two cables. For example, when cable 12 is displaced in the direction of arrow 16 in FIG. 1 by a particular amount of displacement, this amount of displacement is transmitted to mobile linking device 14 which is thereby displaced by the same amount and in the same direction. Displacement of mobile linking device 14 in this same direction causes each of strands 25 and 26 of cable 13 to be displaced an amount equal to the displacement experienced by cable 12. However, this displacement of cable 13 is twice as great as cable 12 because both strands 25 and 26 are each displaced by the amount that cable 12 is displaced. This adjusting of the effective length of cables 12 and 13 is useful in adapting the boot to the various morphologies of different skiers. Adjusting means for adjusting the effective lengths of cables 12 and 13 can be provided, as will be discussed below.

It should be clear that depending upon the effective length of cables 12 and 13 that is chosen, mobile linking device 14 will occupy different positions. Furthermore, it should be evident that in order to obtain a precise adjustment of the forces necessary to close the boot on the skier's leg and hold down the foot it is necessary to associate at least one of the means for adjusting the effective length of cables 12 and 13 with the movable linking device.

Because it is necessary to displace the mobile linking device 14 into different positions, it is desirable to provide a housing in or on the boot for mobile linking device 14 which permits this displacement of mobile linking device 14. For example, in the embodiments seen in FIGS. 1 and 2, mobile linking device 14 is adapted to be displaced translationally in the direction of the traction forces exerted by cables 12 and 13 inside a housing 27 which is installed within the thickness of the wall or lining of cuff 5. Alternatively, housing 27 can be positioned on the wall or lining of cuff 5. Housing 27 and mobile linking device 14 are so positioned and so shaped that mobile linking device 14 can be displaced in either direction 28 or direction 29, as seen in FIG. 2 without risk of mobile linking device 14 striking the cuff. In the embodiment illustrated in FIG. 1, the means for adjusting the effective length of cables 12 and 13, and thus the means for also adjusting the position of mobile linking device 14 in housing 27 comprising a screw-plug adjustment system 30, 31 positioned between the lateral walls of tensioning lever 21. Screw 30 is adapted to rotate in two opposite directions. In response to the rotation of screw 30, plug 31 which is attached to screw 30 is displaced translationally upward or downward as seen in FIG. 1. Because cable 12 extends through openings 32 in the lateral walls of tensioning lever 21 to engage plug 31, movement of plug 31 upward or downward moves cable 12 toward or away from journal axis 33 of tensioning lever 21 so as to change the effective length of cable 12. This changing of the effective length of cable 12 changes the position of mobile linking device 14 in housing 27.

As illustrated in FIG. 2, mobile linking device 14 can be provided with a supplementary means of adjusting the effective length of cable 13 The supplementary means comprises two countershafts 15 15*a* which determine, according to the countershaft chosen around which cable 13 is wound, the effective length for cable 13. Furthermore, it will be evident that when cable 13 is moved from one countershaft to the other, the effective length of cable 13 is changed in an amount twice as great as the distance separating the two countershafts because both strands 25 and 26 are displaced when cable 13 is moved from one countershaft to another.

Figure 3:
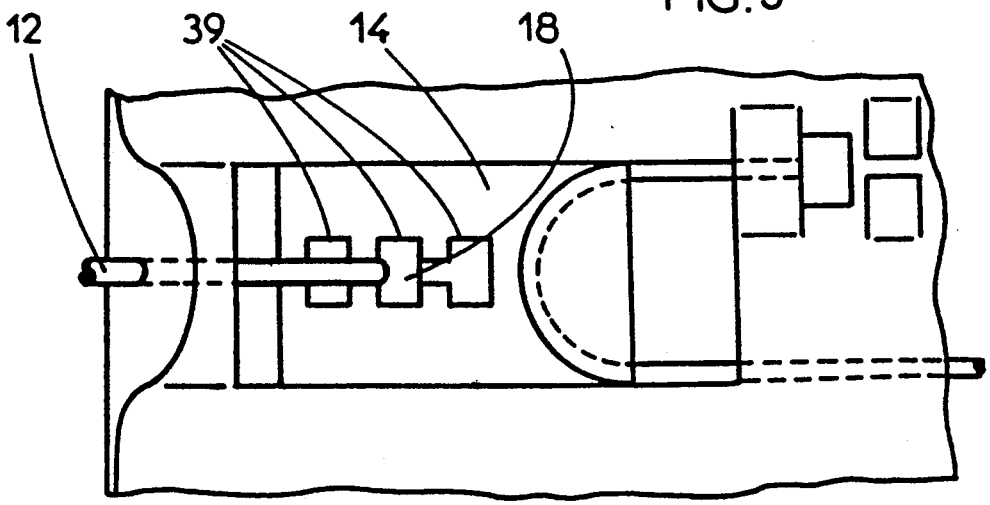
FIG. 3 illustrates a schematic view of a means for pre-adjusting the position of the mobile linking device by means of different spaced apart anchors for anchoring the cable for closing the upper on the lower leg of the skier to the mobile linking device.

FIG. 3 illustrates an alternative embodiment in which mobile linking device 14 comprises several spaced apart anchoring means 39, each of which is adapted to anchor end 18 of cable 12 to mobile linking device 14. By changing the anchoring means with which end 18 of cable 12 is attached to mobile linking device 14, the skier can adjust the effective length of cable 12.

It is also within the scope of the invention to combine the embodiments illustrated in FIGS. 2 and 3 so that one obtains a mobile linking device 14 having several anchoring means 39 for attaching cable 12 to mobile linking device 14, and also having several countershafts 15, each of which is adapted to attach cable 13 to mobile linking device 14.

Figure 23:
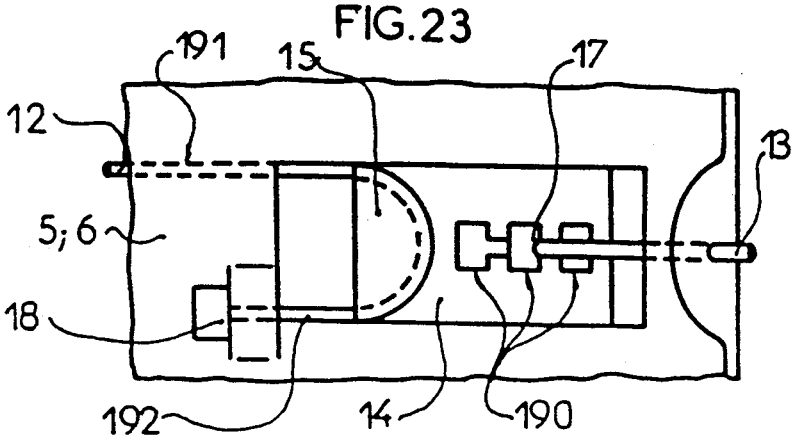
FIG. 23 illustrates a schematic view of another embodiment of the present invention in which a mobile linking device protects the cable from closing the upper on the lower leg of the skier and which also includes a single cable for holding down the foot in the boot.

It is also within the scope of the invention to reverse the arrangement illustrated in FIGS. 2 and 3 so that cable 12 is attached to mobile linking device 14 by being looped around countershaft 15, while cable 13 is attached to mobile linking device 14 by one of a plurality of space part anchors 190. Such an embodiment is illustrated in FIG. 23. As with the case with FIGS. 2 and 3, it is also within the scope of the invention to provide plurality of spaced apart countershafts 15 around which cable 12 can be looped, in addition to a plurality spaced anchors for anchoring the end of cable 13 to mobile linking device 14. It should be noted that in this embodiment illustrated in FIG. 23 end 18 of strand 192 of cable 12 is attached at a fixed point to the spoiler or the cuff, while strand 191 of cable 12 extends toward and engages a means of closing the spoiler on the cuff, such as a tensioning lever.

Figure 4:
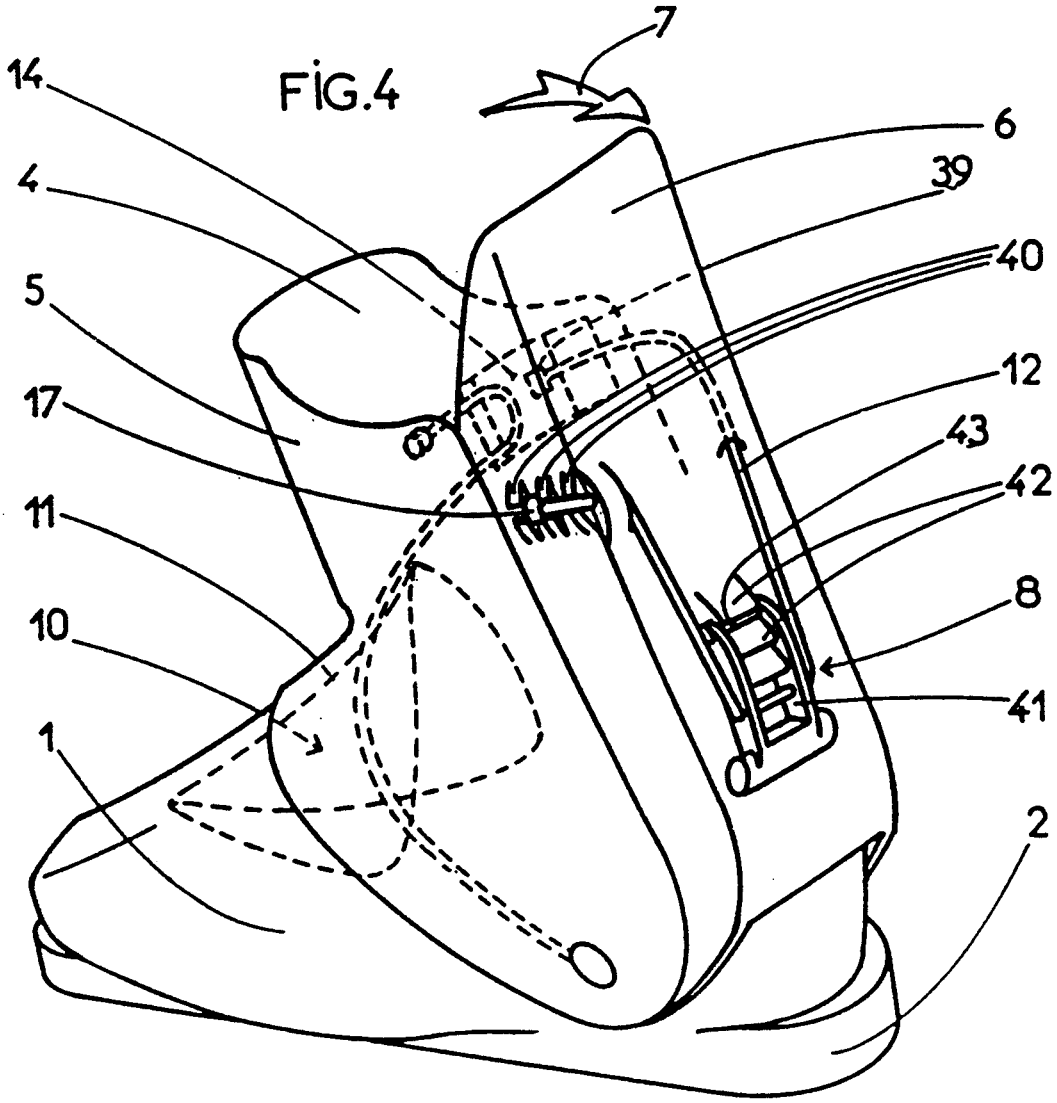
FIG. 4 illustrates a perspective view of a ski boot according to the present invention which includes another means for pre-adjusting the position of the mobile linking device by modifying the effective length of the cable for closing the upper on the lower leg of the skier in a rack installed on the spoiler of the boot.

FIG. 4 illustrates another embodiment of the present invention in which another means is provided for modifying the effective length of cable 12. In this embodiment, several spaced apart attaching means, in the form of anchors on sopping plugs 40 are positioned on one lateral side of spoiler 6. End 17 of cable 12 is adapted to be attached to each of plugs 40. The particular anchor 40 to which end 17 of cable 12 is attached determines the preadjustment of the position of mobile linking device 14, which in turn determines the preadjustment of force with which the foot will be held down and/or the force with which upper 4 can be opened when the skier opens the boot to place his foot and leg therein by pivoting spoiler 6 in the direction of arrow 7.

In the embodiment illustrated in FIG. 4, the boot also comprises a plurality of spaced apart notches 42 positioned on the rear portion of spoiler 6. Each notch 42 is adapted to receive journal pin 43 of tensioning lever 41, which again comprises means for closing the upper on the lower leg of the skier. Each of these notches comprises means for adjusting the tension on cable 12 and therefore the force with which spoiler 6 will be closed on cuff 5 and the force with which the foot will be held down within the boot. This occurs because cable 12 will be tensioned by different amounts, depending upon which notch 42 pin 43 engages, because notches 43 are spaced different distances from anchoring means 40 and the point of attachment of cable 12 to mobile linking device 14.

FIG. 5 illustrates another embodiment of mobile linking device 14 in which mobile linking device 14 comprises two countershafts 15 and 50. Countershaft 15 functions in the same manner as countershaft in the previous embodiments by engaging cable 13 so as to produce two strands 25 and 26, one of which is attached to the cuff and the other which engages the system for holding down the foot in the boot. Plug 50, on the other hand, functions as means for attaching cable 12 to the mobile linking device by looping cable 12 around countershaft 50 so as to form a loop 51 defined by the end of cable 12. This means of attaching cables 12 and 13 to mobile linking device 14 in no way changes the distribution of tensions or forces on the two cables, except that force F seen in FIG. 5 which is associated with cable 12 corresponds to the force applied to loop 51. In a preferred embodiment illustrated in FIG. 5, mobile linking device 14 is assisted in its translational movement in housing 27 by means of guiding elements 52 and 53 which are in the form of projections which engage correspondingly shaped grooves 54 and 55 in housing 27. Housing 27 and grooves 54 and 55 are positioned within the wall or lining of cuff 5 or on the wall or lining of the cuff.

In alternative embodiment illustrated in FIG. 6, instead of using two separate, spaced apart countershafts around which cables 12 and 13 are looped, mobile linking device 14 can instead be formed in the shape of a wheel having two circular recesses 70 and 71 therein. Recess 70 is adapted to engage cable 13 and recess 71 is adapted to engage cable 12. Mobile linking device 14, in this embodiment is in the shape of a stepped cone pulley which comprises first and second stepped portions, one stepped portion comprising recess 70 and the other stepped portion including recess 71.

FIG. 6*a* illustrates a sectional view of the stepped cone pulley described above with respect to FIG. 6 in which the pulley is in its assembled position in which it is assembled with the wall or lining of cuff 5. In this embodiment, cuff 5 has a T-shaped groove 73 having a shape corresponding to the T-shape of a guiding plug 72 of mobile linking device 14 so as to permit encasement therewith.

In still another alternative embodiment illustrated in FIG. 7 mobile linking device 14 includes two teeth 75 around one of which cable 12 is at lest partially looped. One of teeth 75 can comprise an opening having a first portion and second portion. The first portion of the opening in one of teeth 75 is in the form of a retaining notch 76 which is large enough to accommodate end 18 of cable 12. The second portion of the opening in one of teeth 75 has a smaller diameter than notch 76 which is of a sufficiently large enough diameter to accommodate all portions of cable 12 except end 18 which has a larger diameter than the second portion of the opening in one of teeth 75. Therefore, end 18 of the cable 12 will remain a prisoner in notch 76 when it is placed therein. If the skier wishes to preadjust the effective length of cable 12 the skier can displace cable 12 from its position looped around the leftmost tooth 75 in FIG. 7 to the right rightmost tooth 75 in FIG. 7. In either case, end 18 of cable 12 will engage notch 76. Furthermore, it is within the scope of the invention for tooth 75 to be in the form of a ratchet tooth.

It should be understood that it is within the scope of the invention to modify the specific embodiments of the mobile linking device 14 described earlier, and many of these variations will be discussed with respect to the other embodiments illustrated in FIGS. 8–26. Furthermore, it is also within the scope of the invention to use any means to preadjust the effective length of cables 12 and/or 13 and to preadjust the position of mobile linking device 14.

Figure 8:
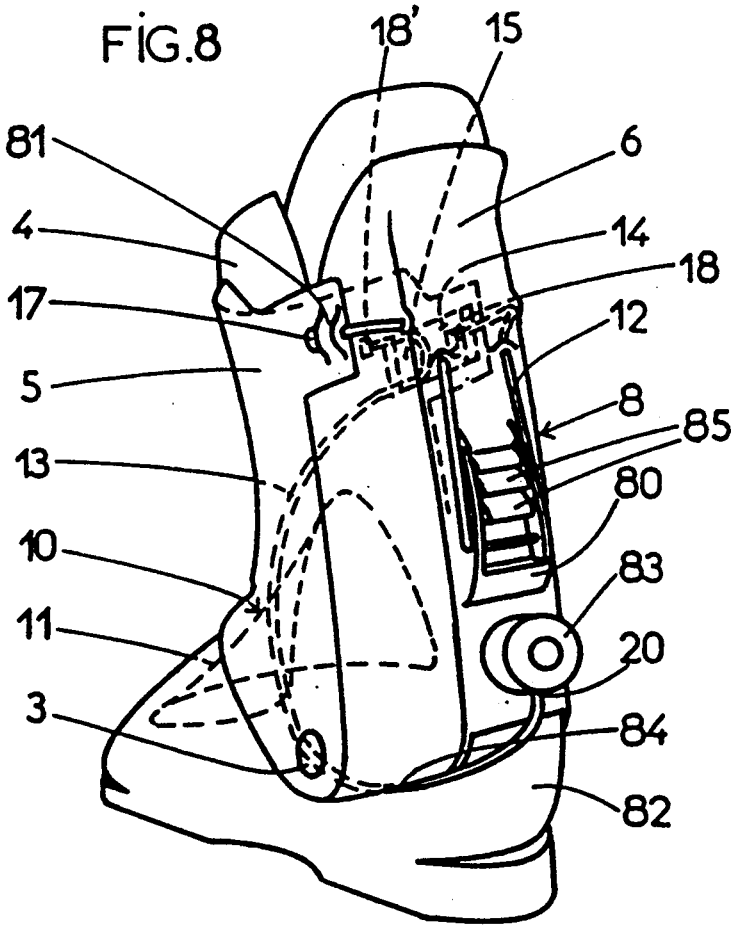
FIG. 8 illustrates a perspective view of a ski boot according to the present invention which includes means for pre-adjusting the position of the mobile linking device by modifying the effective length of the cable for holding down the foot in the boot.

Once such alternative means of preadjusting the position of mobile linking device 14 is illustrated in FIG. 8. In FIG. 8, the boot is provided with a roller 83 of a known type which is attached to end 20 of cable 13. By rotating roller 83 one end of cable 13 is rolled up on roller 83 thereby adjusting the effective length of cable 13.

In addition, FIG. 8 also discloses means for adjusting the effective length of cable 12. This means comprises a plurality of spaced apart notches 85 which are positioned on the rear portion of the rear spoiler. The end of tensioning lever 80 acts a journal element or pin which is adapted to engage each of these plurality of spaced apart notches 85. By changing the notch in which one end of lever 80 positioned, the skier can change the effective length of cable 12. As illustrated in FIG. 8, end 18 of cable 12 is attached at an attachment point to mobile linking device 14. In this embodiment mobile linking device 14 is adapted to slide in a housing installed in one lateral side of cuff 5. Cable 12 then extends rearwardly to one portion of spoiler 6 and engages tensioning lever 80. Cable 12 then extends from tensioning lever 80 to a second portion of spoiler 6 and eventually anchors itself on the other lateral side of cuff 5 at end 17. The point at which end 17 is anchored on one lateral side of cuff 5 at attaching element 81 is at approximately the same height at which end 18 of cable 12 and end 18' of cable 13 is attached to the other lateral side of the cuff.

In this embodiment, end 18' is cable 13 is anchored at a fixed point spaced a predetermined distance from mobile linking device 14 on the same lateral side of the cuff to which mobile linking device 14 is attached. As in FIG. 1, cable 13 then extends through an opening in the cuff so as to extend inside the boot and contacts the top of anatomical plate 11 of system 10 for holding down the foot in the boot. Cable 13 is then guided inside the boot by means known in the art, either around or through journalled element 3. From this point cable 13 extends through a groove 84 hollowed out in the interior rear perimeter of spoiler 6 in the area of heel 82, and then ascends to attach end 20 of cable 13 to the inside of roller 83. As a result, depending upon the position chosen for the preadjustment of mobile linking device 14 in housing 27, cable 13 will be coiled around roller 83 to a greater or lesser extent, thereby modifying the tension or force for holding down the foot. Furthermore, the particular notch 85 chosen by the skier into which one end of lever 80 is engaged will determine the force with which spoiler 6 is closed against cuff 5 and the lower portion of the leg of the skier. As a result of this type of arrangement, roller 83 permits the skier to precisely adjust the force for holding down the foot and for closing the upper and lower leg of the skier so that these forces can be varied progressively and continuously even when the boot is worn by the skier.

Figure 9:
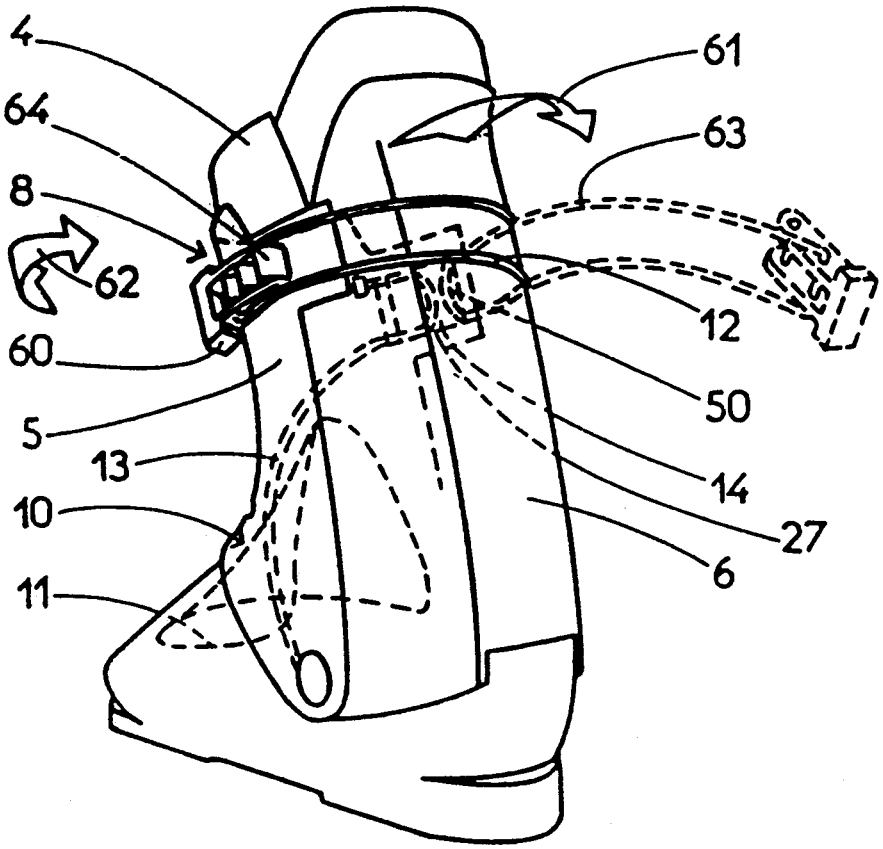
FIGS. 9 and 10 illustrate perspective views of alternative embodiments of the ski boot of the present invention using the mobile linking device of the present invention.

FIG. 9 illustrates an alternative embodiment which comprises means for closing the upper on the lower leg of the skier which does not induce rocking of the boot when automatic closing of the boot is performed. In this embodiment housing 27 is formed so as to be sufficiently large that regardless of the size of the short perimeter of the heel or of the perimeter of the lower leg of the skier mobile linking device 14 is not pressed against cuff 5 during closing of the boot. Furthermore, housing 27 and mobile linking device 14 are so structured that the forces generated due to these variations in the short perimeter of the heel and the perimeter of the lower leg of different skiers are fully distributed between the two cables. To accomplish these objectives, the embodiment seen in FIG. 9 uses means 8 for closing the upper on the lower leg of the skier which comprises a tensioning element or stretcher 60 adapted to engage a plurality of spaced apart notches 64 which are integral with one lateral side of cuff 5. Tensioning element or stretcher 60 is connected to cable 12 so as to tension cable 12 thereby tightening the upper on the lower leg of the skier when tensioning element 60 engages one of notches 64. Notches 64 can be in the form of a ratchet notches. After element 60 engages none of notches 64, element 60 is then clamped and locked within one of notches 64, thereby tensioning cable 12. In addition, cable 12 is also connected, at its end opposite from the end attached to tensioning element 60, to a countershaft 50 attached to the mobile linking device 14. Portion 12' of cable 12 is looped around the portion of countershaft 50 and cable 12 extends from countershaft 50 around spoiler 6 at least partially. As a result, when tensioning elements 60 is rocked or pivoted in the direction of arrow 62 as seen in FIG. 9, cable 12 can be displaced out of contact with spoiler 6 as is seen by dashed lines 63 in FIG. 9. When this occurs the spoiler is totally free to pivot, and therefore spoiler 6 can be pivoted in the direction of 61 so as to open the boot to permit the foot and leg to be placed into or taken out of the boot. In this embodiment the force which closes the upper on the lower leg of the skier is distributed on upper 4 and is distributed to system 10 for holding the foot down in the boot via mobile linking device 14.

Figure 10:
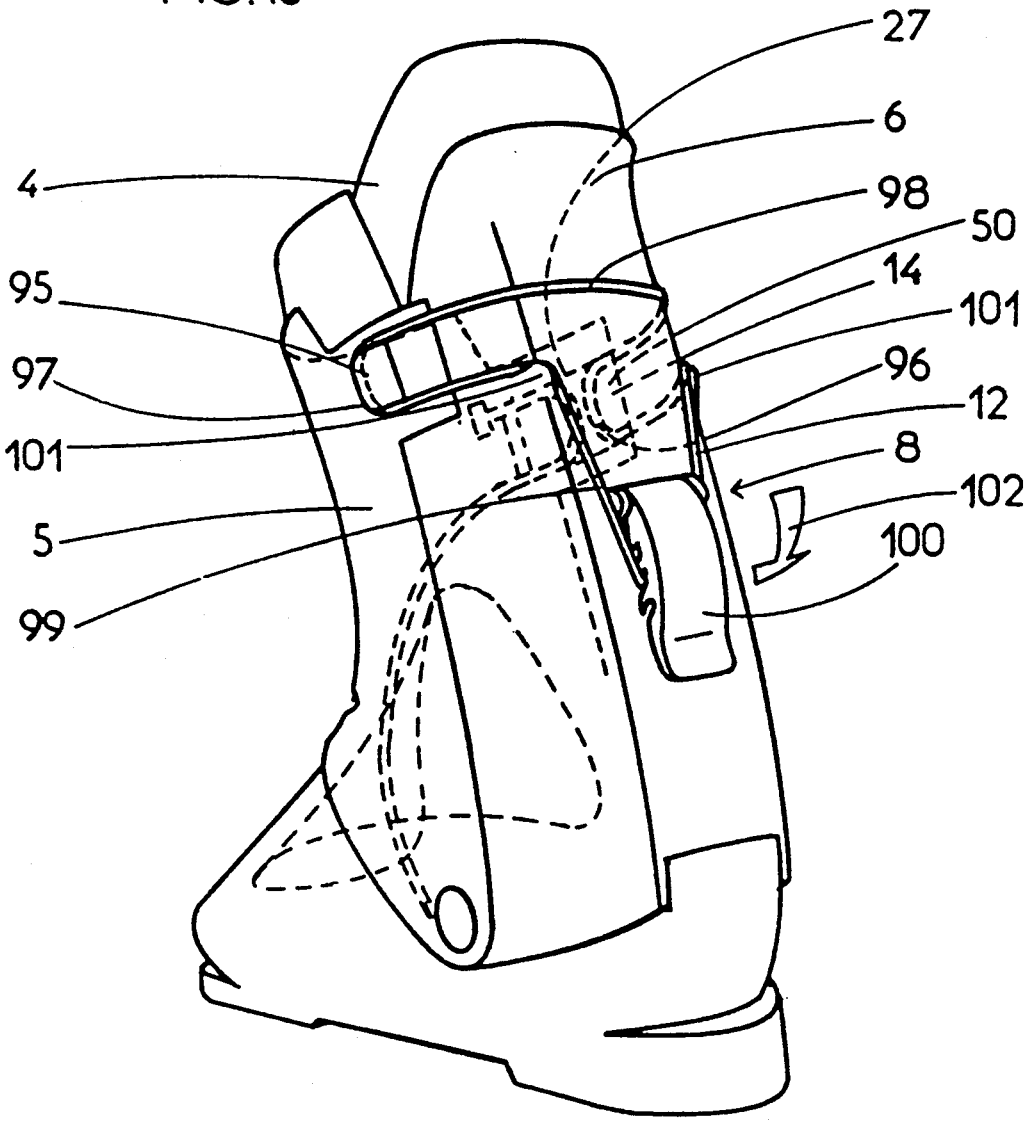

FIG. 10 illustrates another embodiment of the present invention in which the force for closing the upper on the lower leg of the skier is distributed symmetrically on cuff 5 and spoiler 6. In this embodiment cable 12 is attached to opposite lateral sides of cuff 5 by attaching loops 96 and 97 of cable 12 and cuff 5, respectively. Loop 96 is looped around countershaft 50 of mobile linking device 14. Furthermore, another countershaft 95 is provided on the other lateral side of cuff. Loop 97 of cable 12 is looped around this countershaft 95.

In addition, as was discussed earlier with respect to the embodiment illustrated in FIGS. 1, 8 and 9, mobile linking device 14 is preferably positioned on the inner surface of the boot at the top portion of the cuff. In this embodiment countershaft 95 is preferably positioned on the opposite side of the cuff from mobile linking device 14 so that countershaft 95 and mobile linking device 14 are disposed symmetrically on the boot with respect to the longitudinal plane of symmetry of the boot. Strand 98 of cable 12 connects mobile linking device 14 with countershaft 95. This is accomplished by extending strand 98 of cable 12 around spoiler 6. Cable 12 then extends from strand 98 across spoiler 6 to countershaft 95 so that loop 97 engages countershaft 95, and then around the countershaft 101 positioned on one lateral side of the spoiler. From countershaft 101 strand 99 of cable 12 extends downwardly on the rear portion of the spoiler to engage a notch in tensioning lever 100. Tensioning lever 100 is provided with the plurality of notches so that cable 12 can be positioned in any one of these notches, thereby changing the tension and the effective length of cable 12 and preadjusting the position of mobile moving device 14. From one of these notches in tension lever 100 strand 99 of cable 12 then extends upwardly around a second countershaft 101 on the opposite side of the rear portion of spoiler 6 so that loop 96 engages countershaft 50 of mobile moving device 14.

When tensioning lever 100 is moved from an open position to a closed position against spoiler 6 in the direction of arrow 102 illustrated in FIG. 10, strands 98 and 99 of cable 12 are simultaneously tensioned as loops 96 and 97 slide on countershaft 95 of cuff 5 of countershaft 50 of mobile linking device 14, respectively. As a result, mobile linking device 14 is translationally displaced in housing 27 which causes a traction force to be produced on cable 13, thereby pressing the foot downwardly into the boot. As a result, the closing of the upper on the lower leg of the skier and the holding down of the foot in the boot are again accomplished by the movement of a single lever in one direction.

Figure 11:
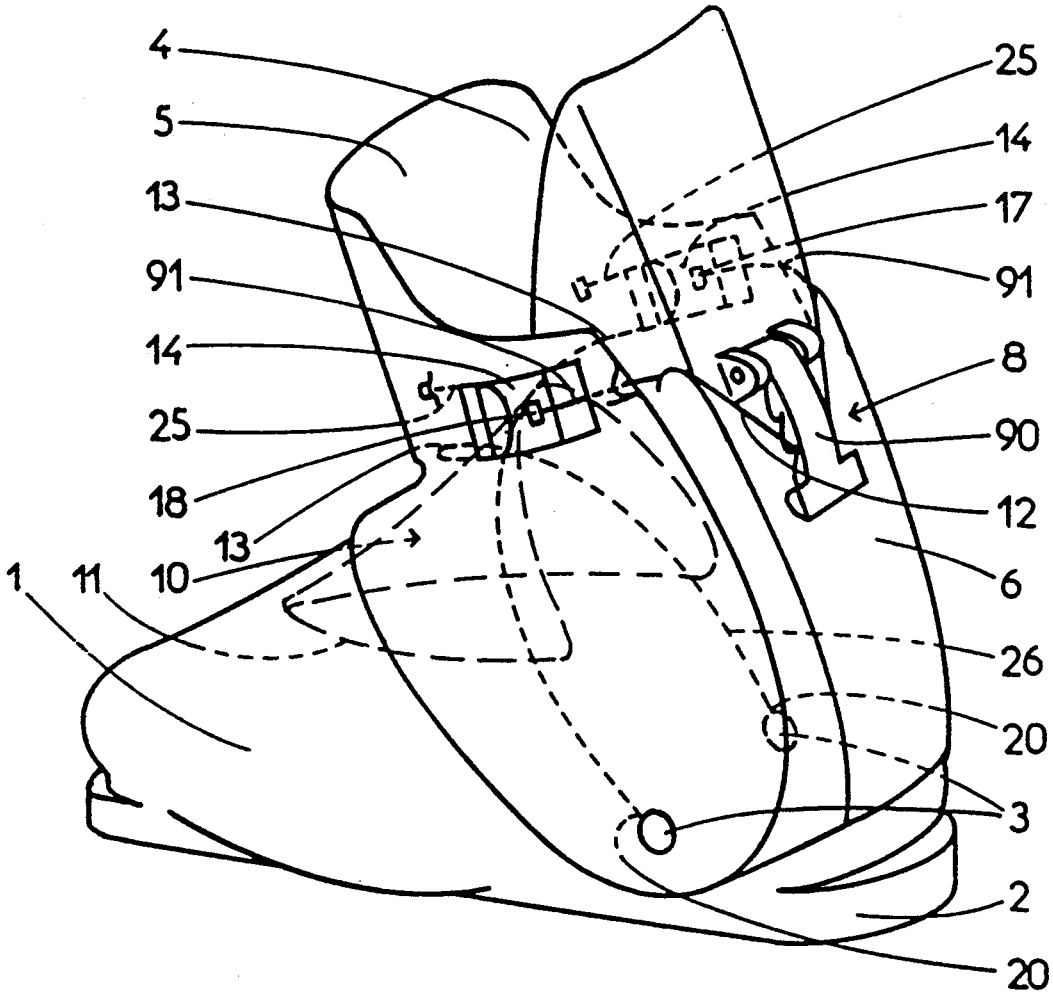
FIGS. 11 and 12 illustrate perspective and top views respectively, of another embodiment of the present invention in which the foot is symmetrically held down in the boot.
Figure 12:
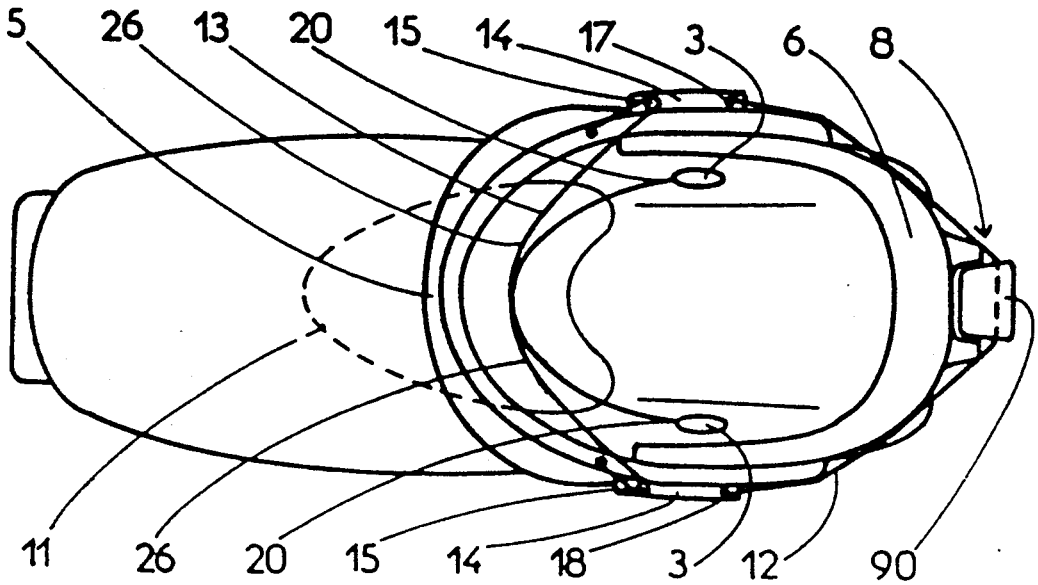

FIGS. 11 and 12 illustrate another embodiment of the present invention in which a ski boot is equipped with two mobile linking devices 14 on opposite lateral sides of the cuff. Also provided is a tensioning lever 90 on the rear spoiler which comprises a plurality of notches into which cable 12 is adapted to engage. When tensioning lever 90 is moved from an open position to a closed position against the rear portion of rear spoiler 6 cable 12 is tensioned thereby closing spoiler 6 on cuff 5. In this embodiment strands 26 of each cable 13 attached to each mobile linking device 14 pass through an opening in the cuff so that they cross over each other and come to rest diagonally in opposite directions on plate 11 of system 10 for holding the foot in the boot. Ends 20 of each cable 13 are then attached to shell base 3 in the vicinity of or substantially at the point of intersection of transverse axis 3 and the shell base. Strand 25 of each cable 13 are attached to cuff 5 on opposite lateral sides thereof.

When the upper is closed on the lower leg of the skier the traction force produced by tensioning element 90 on cable 12 is transmitted equally to each of strands 91 of cable 12 to each mobile linking device 14. This traction force from each cable 12 is then distributed by means of countershaft 15 so that half of this traction force from cable 12 is transmitted to strand 25 of each cable 13 and the other half of the traction force from cable 12 is transmitted to each strand 26 of cable 13 to actuate system 10 for holding down the foot in the boot.

Figure 13:
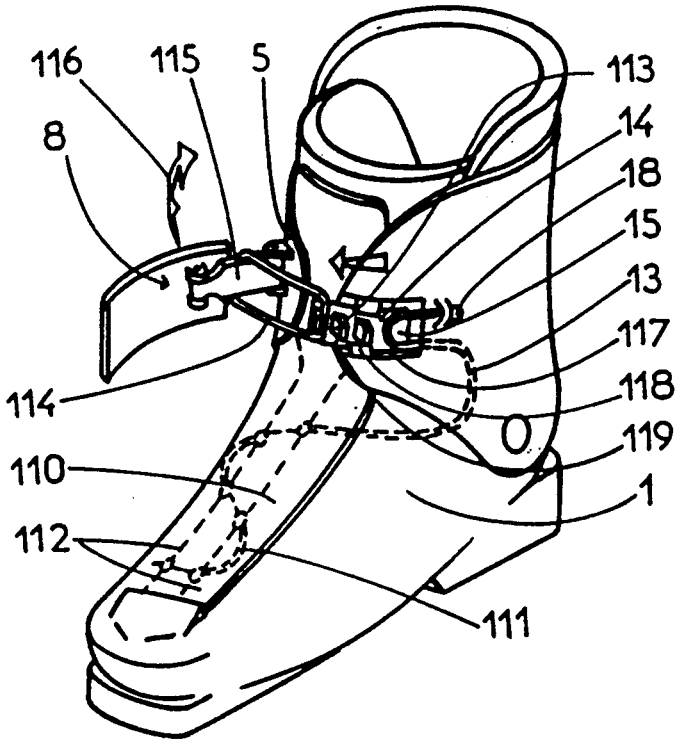
FIG. 13 illustrates a perspective view of a boot according to the present invention having a front opening which is equipped with a mobile linking device according to the present invention.

Another embodiment of the present invention is illustrated in FIG. 13. In this embodiment mobile linking device 14 is applied to a boot having a front opening. The upper comprises two spaced apart straps. The straps form a covering 5' of a collar of upper 5. Mobile linking device 14 is mounted so as to slide on one of these two straps in a support 117 provided on this strap. This strap is further provided with guiding ears 118 which cooperate with edges 119 of mobile linking device 14 to permit the mobile linking device to freely slide in support 117.

In this embodiment shell base 1 also comprises two spaced apart portions 110. One strand of cable 13 extends from countershaft 15 through an opening in one of the straps so as to extend inside the boot. Inside the boot cable 13 passes through a series of guiding cable shafts 111 so as to connect edges 112 of the two portions 110 of shell base 1. The end of this strand is then attached to one of edges 112. The other strand of cable 13 is attached at its end 18 on the strap of the upper to which mobile linking device 14 is attached.

In this embodiment mobile linking device 14 also includes a plurality of teeth 113 which are adapted to engage buckle 114 of tensioning apparatus 115 so that tensioning apparatus 115 and teeth 113 together comprise means for closing the upper on the lower leg of the skier. Buckle 114 functions as the traction element of closing means 8 in this embodiment. In order to close the upper on the lower leg of the skier, one must pull buckle 114 so that it engages one of teeth 113 of mobile linking device 14. Next, tensioning apparatus 115 is pivoted in direction 116 so as to close the tensioning apparatus. Tensioning apparatus 115 comprises a lever attached to buckle 114, and a clamp journalled on the lever. The clamp tensions the lever and buckle 114 when the clamp is closed in the direction of arrow 116. This closing of the tensioning apparatus displaces mobile linking device 14 toward the left as seen in FIG. 13 so as to tension cable 13 thereby bringing edges 112 shell base 1 closer together so as to insure the holding down of the foot in the boot. In addition, the closing of tensioning apparatus 115 also brings together the two spaced apart straps of the upper so as to close the upper on the lower leg of the skier. Furthermore, it should be noted that the foot is held down in the boot by the bringing together of the two portions of the shell base due to the deformation of the shell base as the two edges 112 are displaced closer together to each other.

Figure 14A:
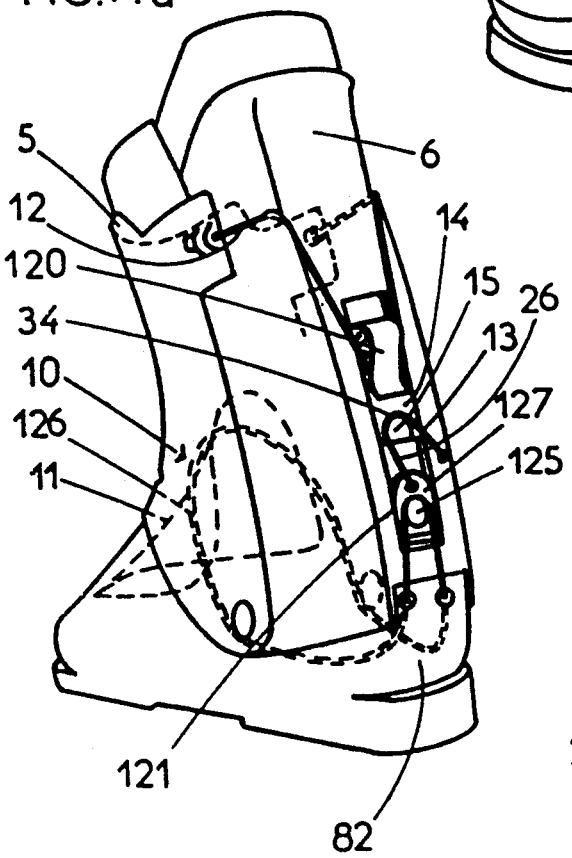
FIGS. 14 and 14*a* illustrate perspective views of alternative embodiments the mobile linking device which is positioned on the rear spoiler of the boot, and which also illustrate a single manipulation element for closing the upper on the lower leg and for holding down the foot in the boot.
Figure 14:
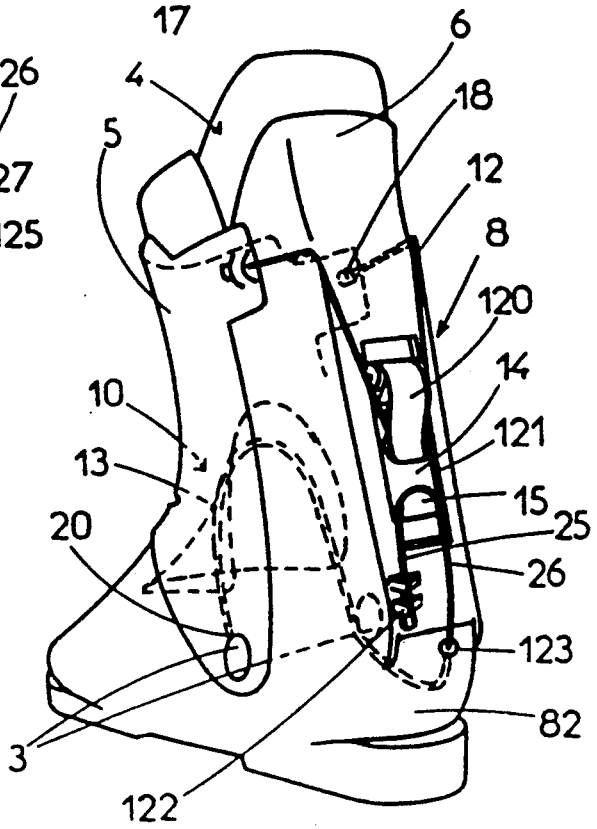

Still another embodiment of the invention is illustrated in FIG. 14. In this embodiment mobile linking device 14 is positioned on the rear spoiler, rather than the cuff as in the previous embodiments. In this embodiment mobile linking device 14 still comprises at least one countershaft 15 to insure the distribution of the traction forces on strands 25 and 26 of cable 13. In addition, this embodiment also includes a closure means 8 such as tensioning lever 120. However, in this embodiment tensioning lever 120 is journalled on mobile linking device 14. Mobile linking device 14 is mounted in an appropriate guiding or housing 121 on the rear spoiler so that mobile linking device 14 is adapted to be displaced translationally on rear spoiler 6. In addition, ends 17 and 18 of cable 12 are attached on opposite lateral sides of cuff 5 in an identical matter to that described in FIG. 8.

In this embodiment strand 26 of cable 13 extends downwardly through an opening 123 in heel 82 of the boot. After passing through opening 123 strand 26 extends inside the boot substantially in the vicinity of or actually engaging a portion of a journal element 3 positioned on one lateral side of the shell base and the rear spoiler. From this journal element strand 126 engages the top of plate 11 and finally attaches itself at its end 20 to journal element 3 positioned on the opposite lateral side of the shell base and the rear spoiler from the first journal element. End 19 of strand 25 and cable 13 engages one of plurality of notches 122 positioned on rear spoiler 6. Each of these notches 122 is adapted to receive end 19 of strand 25. As a result, one can preadjust the position of the mobile linking device 14 and one can preadjust the effective length of cable 13 so as to accommodate various skiers having different short perimeters of the heel and different lower leg perimeters. In addition, lever 120 which is attached to mobile linking device 14 can also be used to adjust the effective length of the cables 12 and 13 and to preadjust the position of the mobile linking device. However, lever 120 and notches 122 will function differently to adjust the effective length of cable 13 because anchors 122 adjust the effective length of cable 13 by adjusting the position at which end 19 of cable 13 is attached to the boot, while tensioning lever 120 adjusts the effective length of cable 13 by displacing mobile linking device 14.

Another embodiment of the present invention is illustrated in FIG. 14*a* which is similar to FIG. 14 but with several important differences. First, instead of using a cable for holding the foot in the boot in which one end is anchored to the spoiler and the other end is anchored to or near journal element 3, in FIG. 14*a* a cable 126 is used for holding down the foot in the boot which is in the shape of a closed loop. Cable 126 extends inside the boot so as to partially surround and engage plate 11 on the top thereof and is guided along opposite lateral internal sides of the boot around or near journal element 3 on opposite lateral sides of the boot. From journal element 3 on opposite sides of the boot cable 26 extends through two openings in the heel 82 of the boot. From these two openings in heel 82 of the boot cable 26 is then looped around countershaft 125 on plate 127 on the rear spoiler. Countershaft 125 and plate 127 are adapted to be translationally displaced in housing 121 on the rear spoiler and are adapted to be displaced in the same direction as mobile linking device 14. In this embodiment, mobile linking device 14 is also positioned on the rear spoiler, but is spaced from countershaft 125.

In order to attach the cable for holding down the foot in the boot to the means for closing the upper on the lower leg of the skier and in order to reduce the traction force of means 8 for closing spoiler 6 against the lower leg with respect to system 10 for holding down the foot in the boot, countershaft 125 is attached to mobile linking device 14 by cable 13. One end of cable 13 is fixed to a support plate 127 which supports countershaft 125. The other end of cable 13 is fixed to the rear portion of the rear spoiler 14 spaced at a distance from mobile linking device 14. The intermediate portion of cable 13 between its two ends is looped around countershaft 15 of mobile linking device 14. In addition, tensioning lever 120 is attached to the mobile linking device 14. Thus, when tensioning lever 120 is displaced from its open to its closed position so as to produce a traction force on cable 12 for closing spoiler 6 against 5 this traction force is communicated directly to mobile linking device 14, which is displaced. This displacement of mobile linking device 14 displaces support 127 which in turn displaces countershaft 25 by means of only one strand 26. If the traction force on cable 12 is F, then the traction force on countershaft and therefore on cable 126 will be F/2. Thus, countershaft 15 serves as a protector for insuring that only a portion of the force from cable 12 is communicated to cable 126 that holds down the foot in the boot.

As was discussed earlier, the adjustment of the effective length of cables 12 and/or 13 and the preadjustment of the position of the mobile linking device 14 in its housing on the boot were accomplished by: changing the position of the end of one of the cables, as was illustrated in FIGS. 3, 4, 8, and 14; by changing the position of an intermediate portion of the cable which is looped around an adjustment element such as a countershaft or a plug attached to a screw as illustrated in FIGS. 1, 2 and 7; by using the means for closing the upper on lower leg of the skier itself to change the effective length of the cables or to preadjust the position of the mobile linking device 14 as illustrated in FIGS. 1, and 9–; or by changing the attachment points of the cables on the mobile linking device by equipping the mobile linking device with a plurality spaced apart anchors.

Figure 15:
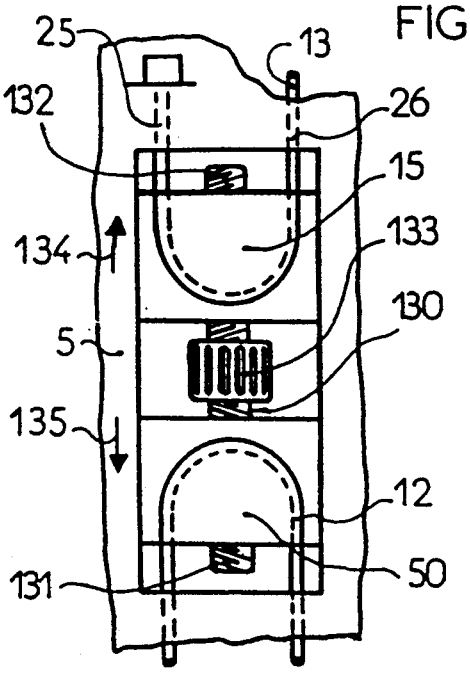
FIG. 15 illustrates an enlarged view of an alternative embodiment of the mobile linking device of the present invention which includes a progressive adjustment system for adjusting the position at which the two cables for holding down in the boot and for closing the upper on the lower leg of the skier are attached to the mobile linking device for the purpose of pre-adjusting the position of the mobile linking device in its housing.

In order to improve the precision with which the effective length of the cables is adjusted and in order to improve the precision with which the preadjustment of the position of the mobile linking device 14 is effected, the embodiment illustrated in FIG. 15 has been developed. In this embodiment mobile linking device 14 comprises two portions 15 and 50 which respectively attach cable 13 and cable 12 to the mobile linking device. In one embodiment these portions 15 and 50 may comprise two countershafts as in the previous embodiments. The distance between these portions 15 and 50 may be altered by means of a screw 130. Screw 130 comprises a first portion 131 and a second portion 132. The first portion of screw 130 is threaded in a first direction 135 and engages a threaded opening in portion 50 of the mobile linking device. The second portion of screw 130 is threaded in a direction 134 opposite from the first direction and engages a threaded opening in portion 15 of the mobile linking device. Also provided is a control roller 133 which is integral with screw 130 and is preferably positioned at substantially the center of screw 130 along the length thereof, between portions 15 and 50 of the mobile linking device. Rotation of control roller 133 rotates screw 130. Depending upon the direction of rotation of screw 130, portions 15 and 50 are either moved toward each other or away from each other. As a result, the manipulation of control roller 133 causes the simultaneous and reciprocal adjustment of the effective length of the cables 13 and 12. Also, in all of these embodiments system 10 for holding the foot down on the inside of the boot and for the means closing the upper and the lower leg of the skier are provided with two different cable circuits, one of which at least acts upon the other via mobile linking device 14. Nevertheless, the cable circuit for closing the upper on the lower leg of the skier is based upon the principles developed by Applicants in French Patent No. 82 19676 which is hereby incorporated by reference thereto and which relates to an integrated system for closing the boot that uses at least one countershaft positioned substantially at the level of the attachment points of the cable for closing the upper on the lower leg of the skier positioned on the front of the upper.

Figure 16:
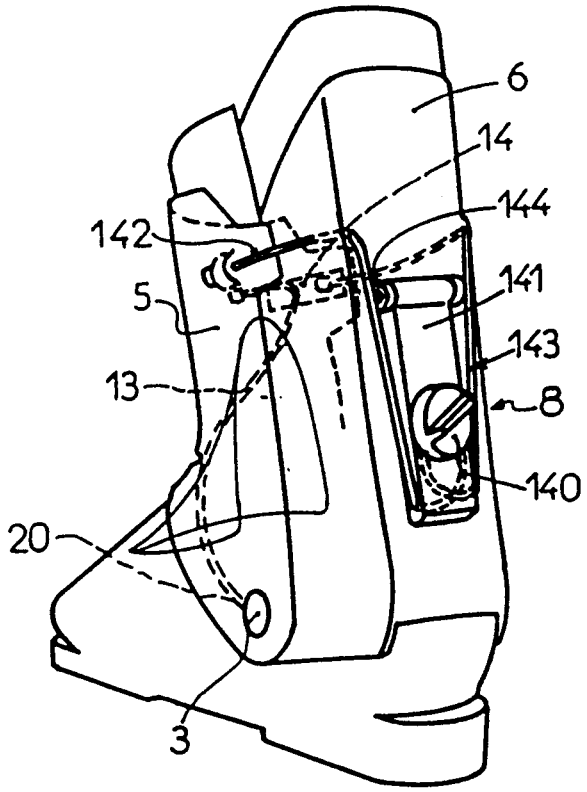
FIGS. 16 and 17 illustrate perspective views of another embodiment of the ski boot according to the present invention in which pre-adjustment means are provided for pre-adjusting the position of the mobile linking device and for adjusting the length of the cable for closing the upper on the lower leg of the skier by means of a roller associated with a single manipulation element for closing the upper and for holding down the foot in the boot.
Figure 17:
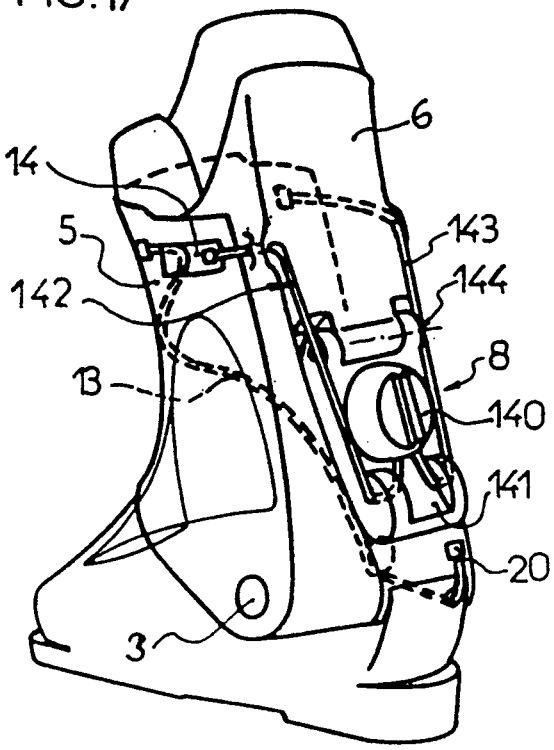

Two additional embodiments are illustrated in FIGS. 16 and 17 which both use a roller 140 to preadjust the position of mobile linking device 14. Roller 140 in both of these embodiments is positioned on tensioning or stretching lever 141. Tensioning lever 141 is journalled on the rear portion of spoiler 6 and is attached to the cable for closing the upper on the lower leg of the skier. Furthermore, lever 141 permits the adjustment of the effective length of the cables 142 and 143 for closing the upper on the lower leg of the skier. Roller 140 is positioned on the rear spoiler at the point near the ends of cable 142 and 143. Cables 142 and 143 are attached to roller 140 in such a manner that roller 140 winds or unwinds and therefore tensions or untensions cables 142 and 143 simultaneously in the same direction when roller 140 is rotated. Depending upon the direction of rotation of roller 140 cables 142 and 143 are either wound or unwound.

In addition, in both of these embodiments illustrated in FIGS. 16 and 17 tensioning lever 141 is journalled on rear spoiler 6 by the journal element 144 at one end thereof so that tensioning element 141 comprises a single manipulation element which comprises an integral means for adjusting the position of the mobile linking device 14 as well as for adjusting the effective length of the cables for holding down the foot in the boot and for closing the upper on the lower leg of the skier. In addition, the attachment point of end 20 of cable 13 to the boot can be provided on any portion of shell base 1 or any portion of the upper such as the cuff 5 or spoiler 6. Thus, FIG. 17 for example illustrates an embodiment in which end 20 of cable 13 is anchored to the lower rear portion of spoiler 6. From that attachment point, cable 13 extends downwardly through an opening in the heel of the boot. From the opening in the heel of the boot cable 13 then extends on the inside of the boot over plate 11 to engage plate 11 and then finally around a countershaft on mobile linking device 14 to an attachment point on the cuff spaced from mobile linking device 14. In addition, in FIG. 17 cables 142 and 143 extend upwardly from roller 140 on opposite lateral sides of spoiler 6 and each of these cables engages a countershaft positioned on opposite lateral sides of spoiler 6. From this point cable 142 is attached to mobile linking device 14 and cable 143 is attached at a fixed point on cuff 5 on a lateral side of cuff 5 opposite from mobile linking device 14.

In FIG. 16, on the other hand, end 20 of cable 13 is attached to a journal element 3 which attached one lateral portion of spoiler 6 with a lateral side of the shell base. From journal element 3 cable 13 engages the top of plate 11 and engages the countershaft on mobile linking device 14, and then extends away from mobile linking device 14 so that end 19 of cable 13 is attached to cuff 5 at a distance from mobile linking device 14. Cables 142 and 143 are attached to the boot in a similar manner as the embodiment illustrated in FIG. 17.

Figure 19:
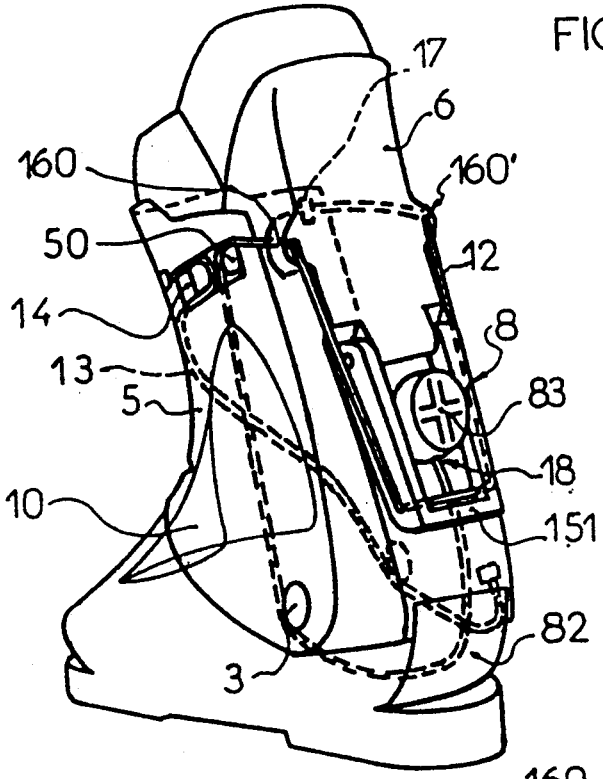
FIGS. 18, 19, and 20 illustrate perspective views of alternative embodiments of ski boots according to the present invention and alternative embodiments of means and methods for pre-adjusting the position of the mobile linking device by means of a roller which is independent from the means for closing the boot on the lower leg of the skier, but which is positioned adjacent to this closing means.
Figure 20:
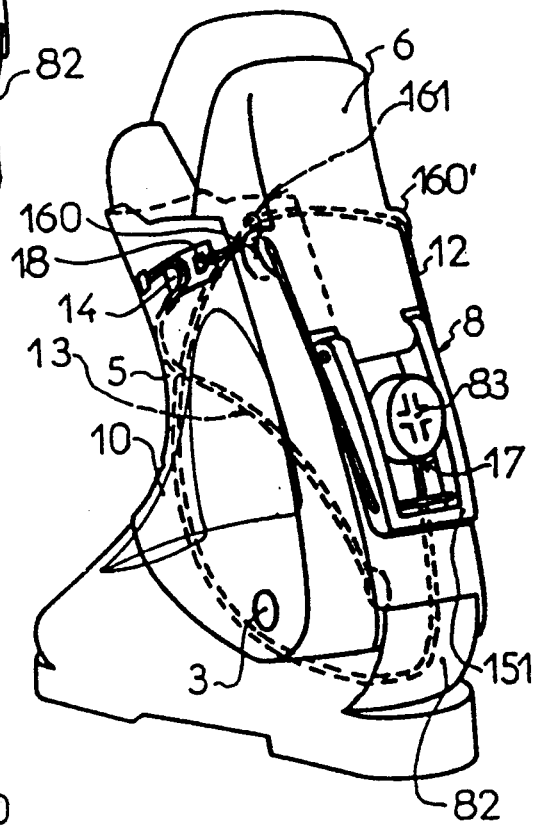
Figure 18:
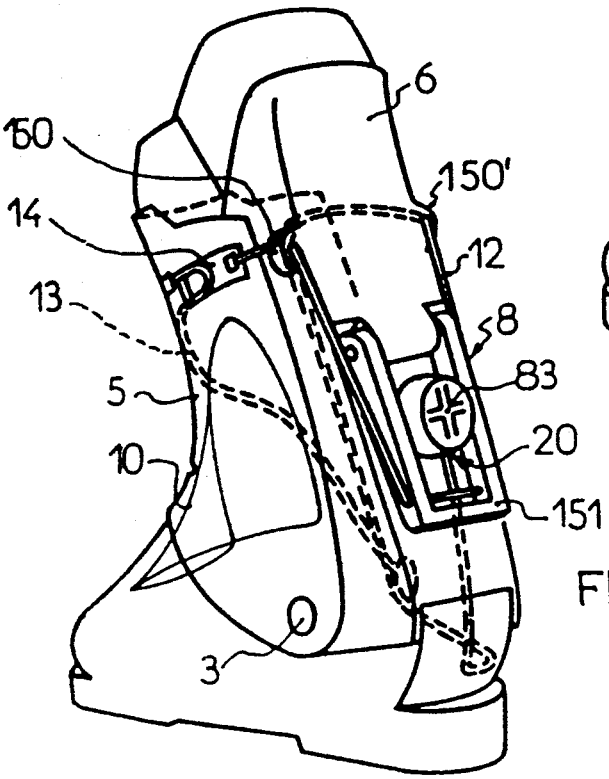

FIGS. 18–20 illustrate additional alternative embodiments in which the preadjustment of mobile linking device 14 is performed by a roller 83 as was described earlier with respect to the embodiments illustrated in FIG. 8. However, in the embodiments illustrated in FIGS. 18–20 roller 83 is positioned between the lateral arms of closing means 8, as taught by Applicant's French Patent No. 84.02900, which is hereby incorporated by reference thereto.

In the embodiment illustrated in FIG. 18 cable 12 is attached to one end to mobile linking device 14. In this embodiment mobile linking device 14 is positioned on one of the lateral sides of the upper. Cable 12 extends from mobile linking device 14 away from cuff 5 and towards spoiler 6. Cable 12 engages a countershaft 150 positioned on one lateral side of spoiler 6 and then passes downwardly from countershaft 150 to a tensioning or stretching lever 151. Tensioning lever 151 is journalled on the rear portion of spoiler 6. In addition, tensioning lever 151 comprises two lateral arms between which roller 83 is positioned. Each of these lateral arms comprises an opening therein which is adapted to receive cable 12. Thus, cable 12 extends from return element 150 through one opening in one lateral arm of lever 151, and then extends through the opening in the other lateral arm 151 to then extend upwardly again to another countershaft 150' positioned on the other lateral side of spoiler 6. From countershaft 150' cable 12 extends through an opening in cuff 5. Inside cuff 5, cable 12 extends laterally across cuff 5 and then downwardly to the lower part of the shell base with the aid of guiding means which are known in the art but are not illustrated in FIG. 18. Cable 12 then exits the interior of the shell base at the lower portion of the spoiler 6 through an opening therein, and is then attached to roller 83 at its end 20. Cable 13 is attached at one end to cuff 5 and is attached at its other end to journal element 3 positioned on one the lateral side of the boot opposite from the side to which the other end of cable 13 is attached to the boot.

In the embodiment illustrated in FIG. 19, end 17 of cable 12 is anchored to the upper part one lateral side of cuff 5. From the top of cuff 5 cable 12 then extends rearwardly to engage countershaft 160' on spoiler 6. From countershaft 160' cable 12 extends downwardly through an opening in one lateral arm of tensioning lever 151 and then extends through an opening in the other lateral arm of tensioning lever 151. From this point cable 12 extends again upwardly along the other lateral side of rear spoiler 6 so as to engage countershaft 160. From countershaft 160 on rear spoiler 6 cable 12 extends forwardly to partially wind itself on countershaft 50 of mobile linking device 14. From countershaft 50 cable 12 extends downwardly to engage or to pass in the vicinity of journal element 3 on one lateral side of the boot. From journal element 3 cable 12 extends rearwardly toward heel 82 of the boot and then extends toward roller 83 and passes through an opening in the rear spoiler to attach end 18 of cable 12 to roller 83. In this embodiment one end of cable 13 is attached to one lateral side of cuff 5. Cable 13 then loops around another countershaft attached to mobile linking device 14 and then through an opening in the cuff so as to pass inside the boot and to engage plate 11. From plate 11 cable 13 extends rearwardly to engage or to extend in the vicinity of journal element 3 positioned on the other side of the boot from the journal element engaging cable 12. From journal element 3 cable 13 extends rearwardly to attach itself to the spoiler.

In the embodiment illustrated in FIG. 20 the circuit through which cable 12 extends is a variation of the circuit in FIG. 19. In FIG. 20 after cable 12 winds itself at least partially on countershaft 160' cable 12 extends through an opening 161 in the lining or wall of the cuff and then extends to the interior of the boot to diagonally extend over system 10 and plate 11 and to engage the journal element 3 or pass in the vicinity of journal of element 3. Then as illustrated in the embodiment in FIG. 19, cable 12 extends toward the rear to heel 82 and then extends upwardly to pass through an opening in rear spoiler and to attach its end 17 to roller 83.

It should be understood that system 10 for holding down the foot is not limited to one single anatomical plate 11 positioned between a slipper or an inner boot placed in the shell base, as is illustrated in the embodiments discussed above. For example, it is within the scope of the invention to use several plates for distributing the hold down forces. Also, system 10 for holding down the foot is not limited to systems whose elements are disposed on the interior of the boot for pressing the foot on the inside of the boot.

Figure 21:
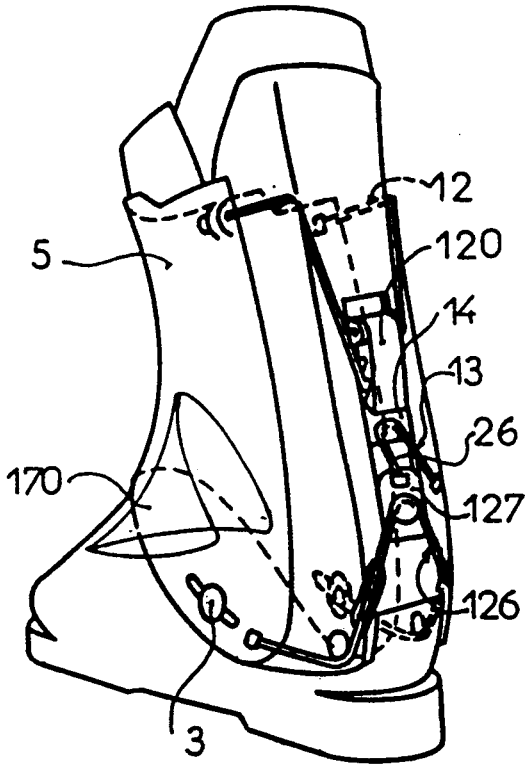
FIG. 21 illustrates perspective view of another embodiment of the ski boot of the present invention and an alternative embodiment of the means for pre-adjusting the position of the mobile linking device applied to a boot with a "tulip"-type opening in which the boot comprises a mobile cuff.

Consequently, it is within the scope of the invention to use a cable for closing the upper on the lower leg of the skier in combination with a mobile linking device which attaches this cable to at least one other cable for holding down the foot in the boot, but which holds down the foot in the boot by exerting the force on the exterior of the boot. Such an embodiment is illustrated in FIG. 21. In this embodiment a cable exerts a traction force via the longitudinal movement of an element which can be the cable itself. This longitudinal movement can be transverse to the journal axis of the boot and can be performed by a mobile element external to the shell base which deforms the boot to obtain the desired holding down of the foot. In the embodiment seen in FIG. 21 the boot comprises a mobile cuff 170 which is adapted to be displaced translationally on the exterior of shell base 1. Furthermore, mobile cuff 170 comprises deformable portions and is adapted to deform in response to the traction force experienced by cable 126. When traction cable 126 exerts a traction force on mobile cuff 170, mobile cuff 170 deforms and translationally moves on the exterior of shell base 1 thereby pressing the foot into the boot to hold the foot down in the boot. Cable 126 is looped around a countershaft attached to a displaceable plate 127 on the rear portion of the spoiler. Plate 127 is connected to mobile linking device 14 by cable 13. One end of cable 13 is attached to plate 127 and the other end of cable 13 is attached to the rear spoiler at a distance from plate 127 and mobile linking device 14. The intermediate portion of cable 13 is wound around a countershaft on the mobile linking device 14. In addition, mobile linking device 14 has mounted thereon a tensioning lever 120 for tensioning cable 12. When tensioning lever 120 is moved into its closed positioned to tension cable 12 mobile linking device 14 is displaced. The displacement of mobile linking device 14 is communicated to support 127 by cable 13. When cable 127 is displaced this displacement exerts a traction force on cable 126 which in turn exerts a traction force on mobile cuff 170 thereby translationally displacing mobile cuff 170 with respect to the shell base to produce a force holding the foot down in the boot.

Figure 21A:
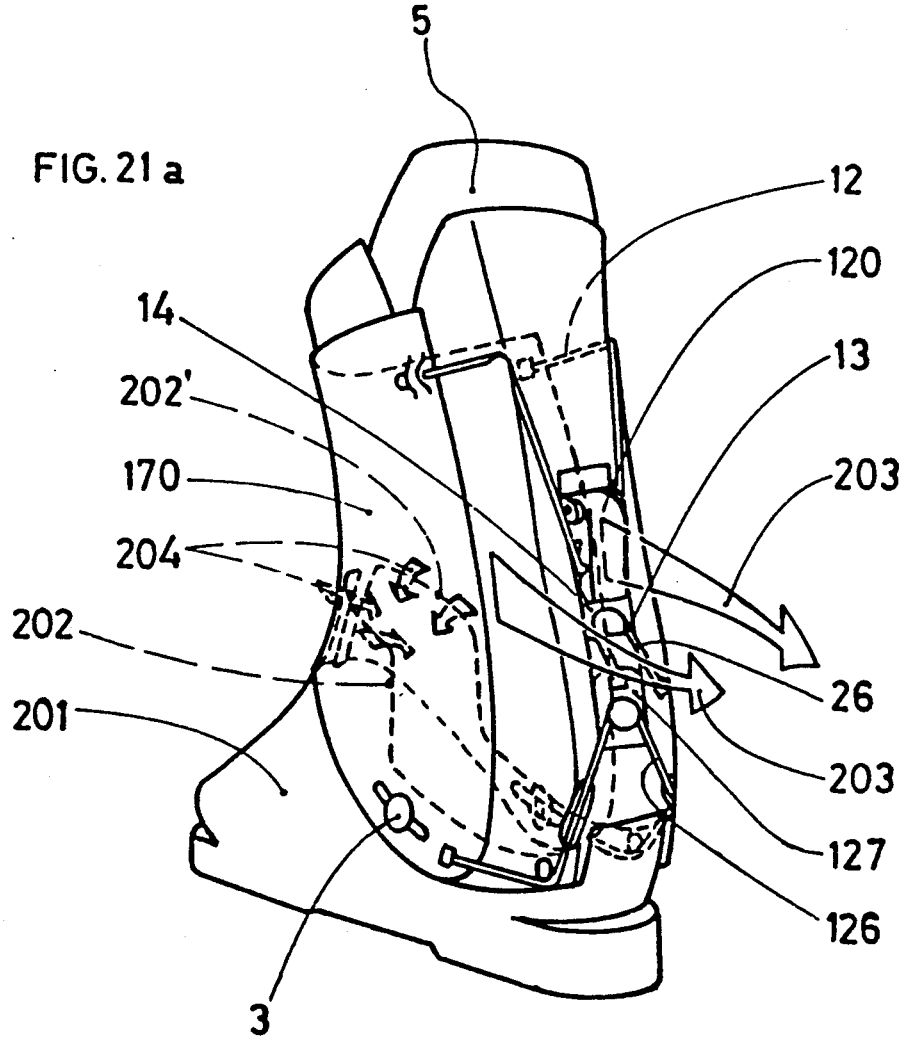
FIG. 21*a* illustrates a more detailed view of an embodiment similar to that illustrated in FIG. 21.

FIG. 21*a* illustrates an embodiment similar to the one illustrated in FIG. 21. In this embodiment, the boot comprises a mobile cuff which is adapted to be displaced translationally in the direction of arrows 203 so as to deform, along arrows 204, the walls of two flaps 202, 202' extending up from shell base 201 to the inside of front mobile cuff 170. The mobile cuff is translationally displaced and deforms flaps 202, 202' in response to a traction force being applied to the mobile cuff by cables 126 so as to press the foot into the boot and to hold the foot down in the boot.

Figure 22:
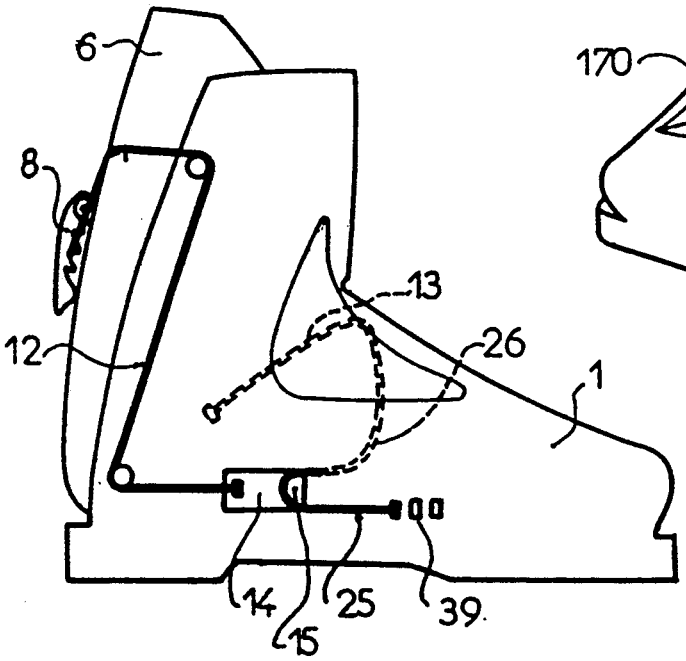
FIG. 22 illustrates a side view of another embodiment of the present invention in which the mobile linking device is positioned on one of the walls of the shell base.

In addition, it is also within the scope of the invention to position mobile linking device 14 on the shell base. Such an embodiment is illustrated in FIG. 22. In FIG. 22 mobile linking device 14 is positioned on one of the lateral walls or in one of the lateral walls of shell base 1. In this embodiment, cable 13 passes through the lining or wall of the shell base from mobile linking device 14 to engage system 10 for holding down the foot. Also in this embodiment cable 12 is attached at one end to mobile linking device 14 and engages countershafts on the rear spoiler for extending cable 12 from mobile linking device 14 to closing means 8. The embodiment illustrated in FIG. 22 functions in the same manner as the embodiment illustrated in FIG. 1.

In the above-discussed embodiments, mobile linking device 14 is adapted to be displaced translationally. However, the invention is not limited to this type of movement of the mobile linking device. It is also within the scope of the invention to provide a mobile linking device 14 that is adapted to rotate in response to a traction force. Such a rotationally displaceable mobile linking device 14 is illustrated in FIGS. 24–26. FIGS. 24 and 26 illustrate a mobile linking device 195 which is adapted to be rotated around axis 196 in response to a traction force exerted by cable 12. Mobile linking device 195 forms a lever 195' to which one end 18 of cable 12 is attached. Because rotation axis 196 is positioned between the point of attachment 39 and 15 of cables 12 and 13, to mobile linking device 14, the direction of the traction forces exerted by cables 12 and 13 on mobile linking device 14 can be the same. Depending upon the embodiment used, the mobile linking device will rotate around either a swiveling axis illustrated in FIGS. 24 and 25, or mobile linking device will rotate by means of a circular slide as seen in FIG. 26. In FIG. 26 mobile linking device 195 comprises a circular sliding element which rotationally slides in a circular housing around axis 196.

In the embodiments illustrated in FIGS. 24 and 26 when a traction force is exerted in cable 12, for example, in a downward direction, the arm of the lever 195' between countershaft 15 and axis 196 will act upon cable 13 in such a manner that strand 25 (which is anchored on the boot in a fixed manner but can also be anchored in an adjustable manner on the boot) and strand 26 will both increase in length as the arm lever 195' rotates around axis 196. Thus, the traction on cable 12 is simultaneously retransmitted to cable 13 for holding down the foot in the boot. In the embodiment in FIG. 25 the functioning of the mobile linking device 201 is similar to the functioning to the embodiments illustrated in FIGS. 24 and 26 except that rotation axis 200 of mobile linking device 201 around which element 201' is adapted to rotate is not positioned in the center of the mobile linking device as it is in the embodiments illustrated in FIGS. 24 and 26 rather rotational axis 200 is positioned off center so that attachment point 39 of cable 12 is positioned between countershaft 15 and axis 200. As a result, the traction force exerted by cables 12 and 13 will be in different directions, and cable 12 and strand 26 of cable 13 extend in opposite directions away from mobile linking device 201.

It should be understood that although the invention has been described with respect to the particular methods, means and embodiments that the invention is not limited thereto but extends to all equivalents within the scope of the claims.

What is claimed is:

1. A ski boot for holding the foot and the lower leg of a skier, wherein said ski boot comprises:
(a) an upper surrounding said lower leg of the skier;
(b) a base for surrounding the foot of the skier;
(c) means for closing said upper on said lower leg of the skier comprising a first traction element;
(d) means for holding said foot in said boot comprising a second traction element; and
(e) means for linking said closing and holding means, wherein said linking means comprises at least one countershaft for changing the direction in which one of said first traction element and said second traction element extends.

2. The boot defined by claim 1 wherein said base comprises a shell base from the top of which said upper extends, wherein said upper is journaled on said shell base.

3. The boot defined by claim 2 wherein said closing means further comprises
means for tensioning said first traction element, wherein said first traction element closes said upper on said lower leg in response to tensioning of said first traction element by said tensioning means.

4. The boot defined by claim 3 wherein said first traction element at least partially surrounds the circumference of said upper.

5. The boot defined by claim 4 wherein said second traction element is arranged for applying a force to hold said foot in said boot when said second traction element is tensioned.

6. The boot defined by claim 5 wherein said linking means links said first and second traction elements.

7. The boot defined by claim 6 further comprising first and second portions, wherein at least one of said first and second portions is adapted to be displaced to close said upper on said lower leg of said skier, wherein said linking means comprises a mobile linking device, wherein said mobile linking device is attached to said first portion of said boot wherein said mobile linking device comprises:
(i) said at least one countershaft around which one of said first and second traction elements is at least partially wound defining a loop comprising first and second strands, wherein said first strand is attached to said first portion of said boot at a distance from said mobile linking device, and wherein said second strand is attached to said second portion of said boot.

8. The boot defined by claim 7 wherein said other of said first and second traction elements is attached to said mobile linking device and is operatively associated to said second portion of said boot.

9. The boot defined by claim 8 wherein at least one of said first and second portions of said boot is adapted to be displaced with respect to the other of said first and second portions so as to occupy open and closed positions, wherein in said open position said boot is adapted to receive said leg and foot therein, wherein in said closed position said upper is closed on said lower leg of said skier, and wherein said holding means further comprises a support, adapted to be positioned on top of said foot, wherein said second traction element engages said support so that said support applies a force to said foot in response to tensioning of said second traction element by displacement of said mobile linking device.

10. The boot defined by claim 9 wherein said tensioning means comprises a lever journaled on said upper.

11. The boot defined by claim 10 wherein said lever is journaled on said upper between open and closed positions, wherein said first traction element is tightened in response to displacement of said lever from said open to said closed position of said lever.

12. The boot defined by claim 11 wherein said tensioning means further comprises a screw and a plug attached to said screw, wherein said first .traction element is attached to said plug, wherein said screw is rotatably attached to said lever, wherein said plug and said first traction element are displaced in response to rotation of said screw.

13. The boot defined by claim 12 wherein said first portion of said boot comprises a cuff and said second portion of said boot comprises a spoiler adapted to pivot with respect to said cuff between open and closed positions, wherein said spoiler comprises a rear portion, wherein said lever is journaled on said rear portion of said spoiler, wherein said lever further comprises two lateral walls each having an opening therein, wherein said first traction element extends through said openings and wherein said plug is positioned between said two lateral walls.

14. The boot defined by claim 12 wherein said first traction element comprises a cable.

15. The boot defined by claim 9 further comprising means for adjusting the position of said mobile linking device, wherein said second traction element comprises an end, wherein said adjusting means is attached to said end of said second traction element.

16. The boot defined by claim 8 wherein said mobile linking device further comprises a plurality of spaced apart countershafts, wherein said second traction element comprises a cable adapted to be at least partially wound around each of said countershafts.

17. The boot defined by claim 8 wherein said second portion of said boot is adapted to be displaced to close said upper on said lower leg of said skier.

18. The boot defined by claim 17 wherein said first and second strands are attached to said first and second portions of said boot at first and second attachment points, respectively, wherein said boot further comprises means for adjusting the position of said first and second attachment points.

19. The boot defined by claim 18 further comprising means for adjusting the position of said other of said traction members on said first and second portions of said boot, wherein said other of said traction members is attached to said first portion of said boot at a third attachment point and is attached to said second portion of said boot at a fourth attachment point, wherein said boot further comprises means for adjusting the position of said third and fourth attachment points.

20. The boot defined by claim 17 wherein said boot further comprises a lower portion, wherein said holding means is positioned in the general vicinity of the said foot in said lower portions of said boot, wherein said holding means further comprises a support, wherein said second traction element engages said support and is adapted to apply a force to said support, wherein said support applies a force to said foot holding said foot down in said boot in response to said second traction element applying force to said support, wherein said support is positioned at substantially the vertical level of the top of said foot.

21. The boot defined by claim 17 wherein said mobile linking device is adapted to be translationally displaced, wherein at least one of said first and second traction means comprises means for translationally displacing said mobile linking device in at least one direction.

22. The boot defined by claim 17 wherein said boot further comprises a wall and a housing positioned in said wall, wherein said mobile linking device slidingly engages said housing.

23. The boot defined by claim 22 wherein said mobile linking device further comprises a circular projection wherein said housing comprises a groove adapted to receive said circular projection, wherein the length of said groove is longer than the diameter of said projection wherein said circular projection slidingly engages said groove.

24. The boot defined by claim 22 wherein said first portion of said boot comprises a cuff having a lateral wall, wherein said housing in positioned in said lateral wall of said cuff.

25. The boot defined by claim 17 wherein said first portion of said boot comprises a cuff comprising first and second lateral walls wherein said second portion of said bolt comprises as spoiler wherein said shell base comprises a lower internal portion having a lateral wall opposite from said first lateral wall of said cuff wherein said first strand comprises an end and wherein said second strand comprises an end wherein said end of said first strand is fixed on said first lateral wall of said cuff, wherein said end of said second strand is positioned on said lateral wall of said shell base, wherein the other of said first and second traction elements comprises a first end and a second end, wherein said first end of the other of said first and second traction elements is attached to said mobile linking device and wherein said second end of said other of said first and second traction elements is attached to said second lateral wall of said cuff.

26. The boot defined by claim 17 wherein said mobile linking device further comprises:

(ii) a plurality of spaced apart countershafts wherein each countershaft is adapted to be attached to said second traction element at a different position on said mobile linking device, wherein said second traction element is at least partially wound around one of said plurality of countershafts to define said loop comprising said first and second strands; and (iii) means for attaching said first traction element to said mobile linking device at an attachment point wherein said attaching means comprises means for adjusting the position of said attachment point.

27. The boot defined by claim 26 wherein said attaching means comprises a plurality of spaced apart anchors wherein each anchor is adapted to attach said first traction element to said mobile linking device at a different position on said mobile linking device.

28. The boot defined by claim 17 wherein said mobile linking device further comprises:

means for attaching said first traction element to said mobile linking device at an attachment point wherein said attaching means comprises means for adjusting the position of said attachment point, wherein said adjusting means comprises a plurality of spaced apart plugs wherein each plug is adapted to attach said first traction element to said mobile linking device at a different location on said mobile linking device, wherein said first traction element is adapted to be attached to each of said plugs.

29. The boot defined by claim 28 wherein said first traction element comprises a first end, a second end, and an intermediate portion between said first and second ends, wherein said first end has a diameter larger than said intermediate portion, wherein one of said plugs comprises an opening therein having a first portion and a second portion wherein said first portion of said opening is sufficiently large to accommodate said first end of said first traction element wherein said second portion of said opening has a diameter smaller than said diameter of said first end of said first traction element and is sufficiently large to accommodate passage of said intermediate portion of said first traction element therethrough.

30. The boot defined by claim 17 wherein said mobile linking device further comprises:

(ii) a plurality of countershafts wherein said first traction element is adapted to be at least partially wound around each of said plurality of countershafts; and (iii) means for attaching said second traction element to said mobile linking device at an attachment point wherein said attaching means comprises means for adjusting the position of said attachment point.

31. The boot defined by claim 30 wherein said attaching means comprises a plurality of spaced apart anchors wherein each anchor is adapted to attach said second traction element to said mobile linking device at a different position on said mobile linking device.

32. The boot defined by claim 31 wherein said first portion of said boot comprises a cuff and said second portion of said boot comprises said spoiler, wherein said spoiler is adapted to be displaced between open and closed positions with respect to said cuff.

33. The boot defined by claim 31 wherein said first portion of said boot comprises a spoiler and said second portion of said boot comprises a cuff, wherein said spoiler is adapted to be displaced between open and closed positions with respect to said cuff.

34. The boot defined by claim 31 wherein said second traction element comprises a first end wherein said first end is attached to one of said anchors, wherein said first traction element comprises a first end wherein said first end of said first traction element is fixed to said first portion of said boot.

35. The boot defined by claim 17 wherein said first traction element comprises a cable wherein said cable comprises a first end and a second end, wherein said second portion of said boot comprises a plurality of spaced apart attachment means for attaching said first end of said cable to said second portion of said boot, wherein said second end of said cable is attached to said mobile linking device.

36. The boot defined by claim 35 wherein said second portion of said boot comprises a spoiler and said first portion of said boot comprises a cuff, wherein said spoiler is adapted to be displaced between open and closed positions with respect to said cuff wherein said spoiler comprises said tensioning means for tensioning said cable to close said spoiler on said cuff wherein said spoiler further comprises a plurality of notches wherein said tensioning means comprises a lever comprising an axis pin around which said lever is adapted to pivot wherein said axis pin engages one of said notches.

37. The boot defined by claim 17 wherein said mobile linking device further comprises first and second countershafts wherein each traction element is at least partially wound around a different countershaft.

38. The boot defined by claim 37 wherein said mobile linking device further comprises means for changing the distance between said two countershafts.

39. The boot defined by claim 38 wherein each countershaft comprises a threaded opening, wherein said changing means comprises a screw, wherein said screw comprises a first portion and a second portion, wherein said first portion of said screw comprises a thread oriented in a first direction and engaging said threaded opening in said first countershaft, wherein said second portion of said screw comprises a thread oriented in a direction opposite from said first direction, wherein said second portion of said screw engages said threaded opening in said second countershaft, wherein said mobile linking device further comprises a control element engaging said screw between said first and countershafts wherein said control element comprises means for displacing said first and second countershafts in opposite directions on said screw.

40. The boot defined by claim 17 wherein said mobile linking device further comprises a substantially circularly shaped element comprising first and second recesses, wherein said first traction element engages said first recess and wherein said second traction element engages said second recess.

41. The boot defined by claim 40 wherein said substantially circularly shaped element comprises a stepped cone pulley.

42. The boot defined by claim 41 wherein said first portion of said boot comprises a cuff, wherein said cuff comprises a lateral wall having a housing therein in which said mobile linking device is positioned, wherein said housing comprises a groove, wherein said stepped cone pulley comprises first and second stepped portions each comprising one of said recesses, wherein said first stepped portion has a smaller diameter than said second stepped portion and wherein said first recess is substantially in the shape of a T and engages said groove of said housing, wherein the shape of said groove corresponds substantially to the shape of said first recess.

43. The boot defined by claim 17 wherein said first and second traction elements extend substantially in the same plane on said mobile linking device, wherein said mobile linking device is adapted to rotate about an axis substantially perpendicular to said plane.

44. The boot defined by claim 43 wherein said mobile linking device further comprises attaching means for attaching said other of said first and second traction elements to said mobile linking device, wherein said axis is positioned between said at least one countershaft and said attaching means.

45. The boot defined by claim 44 wherein said first and second traction elements are attached to said mobile linking device such that said first traction element comprises means for exerting a traction force on said mobile linking device in the same direction as said second traction element.

46. The boot defined by claim 45 wherein said second strands of the traction element engaging said countershaft extend from said at least one countershaft in substantially the same direction as the direction in which said other of said first and second traction elements extends away from said mobile linking device.

47. The boot defined by claim 43 further comprising means for attaching said other of said first and second traction elements to said mobile linking device, wherein said attaching means is positioned between said at least one countershaft and said axis, wherein said first and second traction elements are attached to said mobile linking device such that said first traction element comprises means for exerting a traction force on said mobile linking device in a direction opposite from the direction in which as said second traction element is adapted to exert a traction force on said mobile linking device.

48. The boot defined by claim 43 wherein said boot further comprises a substantially circular housing for housing said mobile linking device, wherein said mobile linking device comprises a substantially circular element adapted to slide in said housing around said axis.

49. The boot defined by claim 17 wherein said foot of said skier comprises malleoli, wherein said shell base comprises a top portion, wherein said first portion of said boot comprises a front cuff and wherein said second portion of said boot comprises a rear spoiler, wherein said front cuff extends from said top portion of said shell base, wherein said rear spoiler is journaled on said shell base substantially at said malleoli, wherein said front cuff comprises a lateral side, wherein said mobile linking device is positioned on said lateral side of said front cuff, wherein said boot further comprises means for adjusting the position of said mobile linking device wherein said adjusting means is attached to at least one of said traction elements.

50. The boot defined by claim 49 wherein said lateral side of said cuff further comprises an internal surface, wherein said mobile linking device is positioned on said internal surface of said lateral side of said cuff.

51. The boot defined by claim 49 wherein front cuff comprises first and second lateral sides wherein said mobile linking device is attached to said first lateral side of said front cuff, wherein said first traction element comprises first and second ends, wherein said first end is attached to said mobile linking device, wherein said second end is attached to said second lateral side of said cuff at substantially the same vertical level as the attachment point of said first end to said mobile linking device.

52. The boot defined by claim 51 wherein said holding means further comprises a support which engages said second traction element, wherein said support applies a force to said foot to hold said foot in said boot in response to tensioning of said second traction element, wherein said boot further comprises a journal element around which said rear spoiler is journaled, wherein said rear spoiler comprises an interior rear periphery having a groove therein, wherein said second traction element comprises first and second ends and an intermediate portion between said first and second ends, wherein said first end of said second traction element is attached to said first lateral side of said front cuff spaced a predetermined distance from said mobile linking device, wherein said intermediate portion engages said support and extends from said support to said journal element and in said groove, wherein said second end is attached to said adjusting means.

53. The boot defined by claim 52 wherein said adjusting means comprises a roller, wherein said second traction element is wound around said roller in response to rotation of said roller.

54. The boot defined by claim 49 wherein said tensioning means comprises a lever journaled on said rear spoiler wherein said lever comprises a first end comprising a journal element, wherein said rear spoiler comprises a plurality of notches wherein said journal element engages one of said notches when said lever is attached to said rear spoiler.

55. The boot defined by claim 49 wherein said cuff comprises two lateral sides, wherein said boot comprises two mobile linking devices each positioned on a different lateral side of said cuff.

56. The boot defined by claim 17 wherein one of said first and second portions of said boot comprises a front cuff and the other of said first and second portions of said boot comprises a rear spoiler journaled on said shell base, wherein said boot further comprises means for adjusting the position of said mobile linking device wherein said adjusting means is attached to one of said traction elements.

57. The boot defined by claim 56 wherein said second traction element is attached to said adjusting means.

58. The boot defined by claim 57 wherein said adjusting means comprises a roller mounted on said rear spoiler.

59. The boot defined by claim 56 wherein said tensioning means comprises a lever journaled on said rear spoiler, wherein said adjusting means is positioned below said lever on said rear spoiler.

60. The boot defined by claim 56 wherein said tensioning means comprises a lever journaled on said rear spoiler, wherein said lever comprises two spaced apart lateral arms, wherein said adjusting means is positioned between said lateral arms of said lever.

61. The boot defined by claim 56 wherein said first traction element is attached to said adjusting means.

62. The boot defined by claim 61 wherein said adjusting means comprises a roller positioned on said rear spoiler.

63. The boot defined by claim 61 wherein said first portion of said boot comprises said front cuff and said second portion of said boot comprises said rear spoiler, wherein said front cuff comprises a first lateral side, a second lateral side, and an inside, wherein said front cuff further comprises an opening therein, wherein said mobile linking device is positioned on said first lateral side of said cuff, wherein said rear spoiler comprises first and second lateral sides and a rear portion between said lateral sides, wherein said rear portion of said rear spoiler has an opening therein, wherein said spoiler further comprises first and second countershafts attached to said first and second lateral sides of said rear spoiler, respectively, wherein said tensioning means comprises a lever journaled on said rear portion of said rear spoiler, wherein said lever comprises two spaced apart lateral arms, wherein each lateral arm comprises an opening therein, wherein said shell base and said rear spoiler comprise lower portions, wherein said lower portion of said rear spoiler comprises an opening therein, wherein said adjusting means is positioned between said lateral arms of said lever, wherein said first traction element comprises first and second ends and an intermediate portion between said first and second end, wherein said first end is attached to said mobile linking device, wherein said intermediate portion extends from said first lateral side of said front cuff to said first countershaft of said rear spoiler, through said openings in said lateral arms of said lever, to said second countershaft of said rear spoiler and through said opening in said front cuff so as to extend into said inside of said front cuff and through said lower portion of said shell base and then through said opening in said lower portion of said spoiler, wherein said second end of said first traction element is attached to said adjusting means.

64. The boot defined by claim 61 wherein said cuff comprises first and second lateral sides, wherein said first lateral side of said cuff has an opening therein, wherein said mobile linking device is attached to said second lateral side of said cuff, wherein said rear spoiler comprises a rear portion comprising a heel portion at the bottom thereof and an opening above said heel portion, wherein said rear spoiler further comprises two lateral sides, wherein said rear spoiler further comprises first and second countershafts each positioned on one lateral side of said rear spoiler, wherein said tensioning means comprises a lever journaled on said rear portion of said rear spoiler, wherein said lever comprises two spaced apart lateral arms, wherein said adjusting means is positioned between said two spaced apart lateral arms of said lever, wherein said mobile linking device further comprises first and second countershafts, wherein said second traction element engages said second countershaft of said mobile linking device, wherein said first traction element comprises a first end, a second end, and an intermediate portion between said first and second ends, wherein said first end of said first traction element is attached to said first lateral side of said cuff, wherein said second end of said first traction element is attached to said adjusting means, wherein said intermediate portion engages said first and second countershafts of said rear spoiler, wherein said intermediate portion is also attached to said lever and engages said first countershaft of said mobile linking device, and wherein said intermediate portion extends through said openings in said first lateral side of said cuff and in said rear portion of said spoiler above said heel portion.

65. The boot defined by claim 61 wherein said holding means further comprises a support, wherein said second traction element engages said support, wherein said support applies a force to said foot to hold said foot in said boot in response to tensioning of said second traction element, wherein said rear spoiler is journaled on said shell base around a journal axis, wherein said cuff comprises first and second lateral sides, wherein said first lateral side of said cuff has an opening therein, wherein said mobile linking device is attached to said second lateral side of said cuff, wherein said rear spoiler comprises a rear portion comprising a heel portion at the bottom thereof and an opening above said heel portion, wherein said rear spoiler further comprises two lateral sides, wherein said rear spoiler further comprises first and second countershafts each positioned on a different lateral side of said rear spoiler, wherein tensioning means comprises a lever journaled on said rear portion of said rear spoiler, wherein said lever comprises two spaced apart lateral arms, wherein said adjusting means is positioned between said two spaced apart lateral arms of said lever, wherein said first traction element comprises a first end, a second end, and an intermediate portion between said first and second ends, wherein said first end is attached to said mobile linking device, wherein said second end of said first traction element is attached to said adjusting means, wherein said intermediate portion extends from said first end to engagement with said first countershaft of said rear spoiler, from said first countershaft of said rear spoiler to engagement with said lever, from said lever to engagement with said second countershaft of said rear spoiler, from said second countershaft of said rear spoiler through said opening in said cuff to engagement with the top of said support, from said support to said journal axis, from said journal axis to said heel of said spoiler, from said heel of said spoiler upwardly through said opening in said rear portion of said spoiler to said second end of said first traction element.

66. The boot defined by claim 56 wherein said adjusting means is positioned on said closing means.

67. The boot defined by claim 66 wherein said adjusting means comprises a roller engaging said first traction element.

68. The boot defined by claim 66 wherein said adjusting means comprises a lever and a clamp engaging said first traction element.

69. The boot defined by claim 66 wherein said adjusting means comprises a screw and a plug attached to said screw which engages said first traction element.

70. The boot defined by claim 56 wherein said first traction element comprises a first end, wherein said adjusting means engages said first end of said first traction element.

71. The boot defined by claim 70 wherein said rear spoiler is journaled on said shell base, wherein said adjusting means comprises a roller positioned on said rear spoiler.

72. The boot defined by claim 17 wherein said tensioning means comprises a locking and tensioning element and spaced apart notches on said boot, wherein each notch is adapted to receive said locking and tensioning element therein, wherein said locking and tensioning element and said notches comprise means for tensioning said first traction means by releasably locking said locking and tensioning element in each of said notches, wherein said locking and tensioning element is attached to said first traction element.

73. The boot defined by claim 72 wherein said notches comprises ratchet notches.

74. The boot defined by claim 73 wherein said first portion of said boot comprises a front cuff, wherein said second portion of said boot comprises a rear spoiler journaled on said shell base, wherein said front cuff comprises first and second lateral sides, wherein said mobile linking device is attached to said first lateral side of said front cuff and wherein said notches are attached to said second lateral side of said front cuff.

75. The boot defined by claim 73 wherein said mobile linking device comprises first and second countershafts, wherein said first traction element engages said first countershaft and said second traction element engages said second countershaft.

76. The boot defined by claim 17 wherein, said first portion of said boot comprises a front cuff and said second portion of said boot comprises a rear spoiler, wherein said closing means comprises means for applying a force distributed symmetrically with respect to the longitudinal plane of symmetry of said boot on said front cuff and said rear spoiler to close said upper on said lower leg of the skier.

77. The boot defined by claim 17 wherein said first portion of said boot comprises a front cuff and said second portion of said boot comprises a rear spoiler, wherein said front cuff comprises first and second lateral sides, wherein said first lateral side comprises a top portion having an inner surface, wherein said mobile linking device is positioned at said inner surface of said top portion of said first lateral side of said front cuff, wherein said mobile linking device comprises first and second countershafts, wherein said second countershaft engages said second traction element, wherein said first countershaft engages said first traction element, wherein said first traction element comprises first and second loops, wherein said first loops is attached to said first countershaft, wherein said second loop is attached to said second lateral side of said front cuff.

78. The boot defined by claim 77 further comprising a second lateral side countershaft to which said first traction element is connected by said second loop, wherein said first countershaft of said mobile linking device and said second lateral side countershaft are positioned symmetrically with respect to a longitudinal plane of symmetry of said boot.

79. The boot defined by claim 78 wherein said rear spoiler comprises a rear portion having first and second lateral sides, wherein said first lateral side of said rear portion of said rear spoiler comprises a first countershaft, wherein said second lateral side of said rear portion of said rear spoiler comprises a second countershaft, wherein said tensioning means comprises a lever journaled on said rear spoiler, wherein said lever comprises a plurality of spaced apart notches, wherein each notch is adapted to receive a portion of said first traction element, wherein said first traction element extends from said first countershaft of said mobile linking device, around at least a portion of said first countershaft of said first lateral side of said rear portion of said rear spoiler to one of said plurality of notches, wherein said first traction element then extends through one of said plurality of notches around at least a portion of said second countershaft of said second lateral side of said rear portion of said rear spoiler to said countershaft of said second lateral side of said front cuff, wherein said first traction element extends at least partially around said countershaft of said second lateral side of said front cuff, around said rear portion of said rear spoiler to said first countershaft of said mobile linking device.

80. The boot defined by claim 17 wherein said first portion of said boot comprises a front cuff and said second portion of said boot comprises a rear spoiler journaled on said shell base around a journal axis between open and closed positions, wherein said front cuff comprises first and second lateral sides, wherein said boot comprises first and second mobile linking devices positioned on said first and second lateral sides of said front cuff, respectively.

81. The boot defined by claim 80 wherein said shell base comprises first and second lateral sides, wherein said first and second mobile linking devices comprise first and second countershafts, respectively, wherein said boot further comprises two second traction elements, wherein each of said second traction elements comprises a first end and a second end and an intermediate portion between said first and second ends, wherein said first end of each second traction element is attached to a different lateral side of said cuff, wherein said second end of each second traction element is attached to a different lateral side of said shell base at substantially the point of intersection between said journal axis and said shell base.

82. The boot defined by claim 81 wherein said holding means further comprises a support, wherein said second traction element is adapted to engage said support, wherein said support applies a force to said foot to hold said foot in said boot in response to tensioning of said second traction element, wherein said intermediate portions of said second traction elements are at least partially wound around a different countershaft of one of said mobile linking devices, wherein said intermediate portions of said second traction elements extend substantially diagonally over the top of said support in different directions.

83. The boot defined by claim 7, wherein said first portion of said boot comprises said upper, wherein said second portion of said boot comprises said shell base.

84. The boot defined by claim 7 wherein said first traction element comprises a buckle.

85. The boot defined by claim 7 wherein said first portion of said boot comprises said upper, wherein said second portion of said boot comprises said shell base, wherein said upper comprises first and second spaced apart portions adapted to be displaced between open and closed positions on said lower leg of said skier, wherein said first traction element comprises means for displacing said first and second portions together into said closed position.

86. The boot defined by claim 85 wherein said mobile linking device is positioned on said first portion of said upper, wherein said mobile linking device further comprises a plurality of spaced apart teeth, wherein said second portion of said upper comprises said tensioning means wherein said first traction element is attached to said tensioning means, wherein said first traction element is adapted to engage each of said teeth, wherein said first and second spaced apart portions of said upper are displaced into said closed position in response to tensioning of said first traction element by said tensioning means when said first traction element engages one of said teeth.

87. The boot defined by claim 86 wherein said first traction element comprises a buckle and said tensioning means comprises a lever attached to said buckle and a clamp journaled on said lever, wherein said clamp is adapted to be displaced between open and closed positions, wherein said clamp tensions said first traction element in said closed position, wherein said buckle closes said first and second portions of said upper when said buckle engages one of said teeth in response to displacing said clamp into said closed position.

88. The boot defined by claim 87 wherein said shell base comprises first and second spaced apart portions, wherein said first and second spaced apart portions of said shell base are adapted to be displaced between an open position and a closed position wherein in said closed position of said shell base said first and second portions of said shell base are closer together than in said open position of said shell base, wherein said first traction element comprises a cable having a first end and a second end and an intermediate portion between said first and second ends, wherein said first end is attached to said first portion of said upper, wherein a portion of said intermediate portion is at least partially wound around said at least one countershaft of said mobile linking device, wherein another portion of said intermediate portion is attached to said first and second portions of said shell base, wherein said second end of said cable is attached to one of said first and second portions of said shell base, wherein said second traction element closes said shell base in response to tensioning of said first traction element.

89. The boot defined by claim 7 wherein said shell base is rigid and comprises malleoli, wherein said upper and said shell base comprise a front portion having an opening therein, wherein said upper is journaled on said shell base at substantially the position of said malleoli, wherein said upper comprises collar, wherein said upper extends upwardly from the top of said shell base, wherein collar comprises a covering comprising two straps, wherein said mobile linking device is positioned on one of said two straps, wherein said boot further comprises means for adjusting the position of said mobile linking device, wherein said adjusting means is attached to at least one of said traction elements.

90. The boot defined by claim 7 wherein said first portion of said boot comprises a rear spoiler.

91. The boot defined by claim 90 wherein said foot comprises malleoli, wherein said rear spoiler is journaled on said shell base at substantially the level of said malleoli, wherein said boot further comprises a front cuff, wherein said cuff comprises means for flexing, wherein said rear spoiler comprises a rear surface, wherein said mobile linking device is positioned on said rear surface of said rear spoiler, wherein said boot further comprises means for adjusting the position of said mobile linking device, wherein said adjusting means is attached to at least one of said traction elements.

92. The boot defined by claim 90 further comprising means for journaling said rear spoiler on said shell base, wherein said second traction element is at least partially wound on said at least one countershaft, wherein said first strand comprises an end, wherein said end of said first strand is positioned on said rear spoiler, wherein said second strand comprises an end, wherein said second portion of said boot comprises said journaling means, wherein said end of said second strand is attached to said journaling means.

93. The boot defined by claim 92 wherein said holding means further comprises a support plate adapted to engage the top of said foot, wherein said shell base and said rear spoiler comprise first and second lateral sides, wherein said journaling means comprises a first portion positioned on said first lateral side of said shell base and said rear spoiler, and a second portion positioned on said second lateral side of said shell base and said rear spoiler, wherein said second strand further comprises an intermediate portion adjacent said end of said second strand, wherein said intermediate portion contacts the top of said support plate and engages said first portion of said journaling means, wherein said end of said second strand is attached to said second portion of said journaling means.

94. The boot defined by claim 93 wherein said rear spoiler further comprises a plurality of notches, wherein each notch comprises means for engaging said end of said first strand, wherein said tensioning means is attached to said mobile linking device, wherein said tensioning means comprises lever journaled on said rear spoiler.

95. The boot defined by claim 94 further comprising a front cuff having first and second lateral sides, wherein said first traction element comprises first and second ends and an intermediate portion between said first and second ends, wherein said first and second ends of said first traction element are attached to first and second lateral sides of said front cuff, respectively, and wherein said intermediate portion of said first traction element is attached to said lever.

96. The boot defined by claim 90 wherein said tensioning means is attached to said mobile linking device, wherein said second traction element is at least partially wound around said at least one countershaft.

97. The boot defined by claim 96 wherein said holding means further comprises a support plate and a cable, wherein said support plate slidingly engages said rear spoiler, wherein said first strand comprises an end and wherein said second strand comprises an end, wherein said end of said first strand is attached to said rear spoiler at a distance spaced from said mobile linking device, wherein said end of said second strand is attached to said support plate, wherein said cable is attached to said support plate and extends inside said shell base and is adapted to be positioned over said foot.

98. The boot defined by claim 97 further comprising journaling means having first and second portions for journaling said rear spoiler on said shell base, wherein said rear spoiler and said shell base comprise two lateral sides, wherein one portion of said journaling means is attached to each lateral side of said rear spoiler and said shell base, wherein said holding means further comprises a support adapted to be positioned over said foot in said shell base, wherein said shell base comprises a heel portion, wherein said heel portion comprises two openings therein, wherein said support plate comprises a countershaft, wherein said cable extends around a portion of said countershaft of said support plate to form two strands, wherein each strand extends through a different opening in said heel of said shell base and engages a different portion of said journaling means, and the top of said support.

99. The boot defined by claim 98 further comprising a front cuff having first and second lateral sides, wherein said first traction element comprises first and second ends, and an intermediate portion, wherein said first and second ends of said first traction element are attached to said first and second lateral sides of said front cuff, respectively, wherein said intermediate portion of said first traction element engages said tensioning means.

100. The boot defined by claim 17 further comprising means for adjusting the position of said mobile linking device wherein said adjusting means is attached to said first traction element.

101. The boot defined by claim 100 wherein said adjusting means comprises a roller, wherein rotation of said roller displaces said first traction element.

102. The boot defined by claim 101 wherein said first portion of said boot comprises a front cuff, wherein said boot further comprises a rear spoiler journaled on said shell base, wherein said rear spoiler comprises a rear portion, wherein said tensioning means comprises a lever journaled on said rear portion of said rear spoiler, wherein said roller is positioned on said lever.

103. The boot defined by claim 102 wherein said holding means further comprises a support plate adapted to be positioned over said foot, wherein said second traction means is at least partially wound around said at least one countershaft, wherein said second traction element comprises a first end and a second end and an intermediate portion, wherein said first end is spaced from said mobile linking device and is attached to said front cuff, and wherein said intermediate portion engages the top of said support plate.

104. The boot defined by claim 103 wherein said rear spoiler is journaled on said shell base around a journal axis, wherein said second end of said second traction element is attached to said shell base at said journal axis.

105. The boot defined by claim 103 wherein said second portion of said boot comprises said rear spoiler, wherein said second end of said second traction element is attached to said rear portion of said rear spoiler below said lever.

106. The boot defined by claim 103 wherein said first traction element comprises a first and a second end and an intermediate portion, wherein said front cuff comprises first and second lateral sides, wherein said mobile linking device is attached to said first lateral side of said front cuff, wherein said first end of said first traction element is attached to said mobile linking device wherein said second end of said first traction element is attached to said second lateral side of said cuff, wherein said intermediate portion of first traction element is attached to said lever.

107. The boot defined by claim 7 wherein said holding means comprises a displaceable front cuff displaceable on the exterior of said shell base, wherein said second traction means comprises means for displacing said front cuff to apply a force to said foot to hold said foot in said boot.

108. The boot defined by claim 107 wherein said cuff is translationally displaceable, wherein said first portion of said boot comprises a rear spoiler, wherein said second portion of said boot comprises said displaceable front cuff, wherein said boot further comprises a cable attached to said front cuff, wherein said boot further comprises a displaceable attaching means for attaching said cable to said second traction means, wherein displacement of said mobile linking device displaces said displaceable attaching means, said cable and translationally displaces said front cuff.

109. The boot defined by claim 108 wherein said rear spoiler is journaled on said shell base, wherein said rear spoiler comprises a rear portion, wherein said mobile linking device, said tensioning means, and said attaching means are positioned on said rear portion of said rear spoiler, wherein said tensioning means is attached to said mobile linking device, wherein said second traction element is partially wound on said at least one countershaft, wherein said first strand is attached to said rear spoiler at a distance from said mobile linking device, wherein said second strand is attached to said attaching means, whereby said attaching means attaches said second strand to said front cuff.

110. The boot defined by claim 7 wherein said first portion of said boot comprises said shell base, wherein said mobile linking device is positioned on said shell base.

111. The boot defined by claim 110 wherein said shell base comprises a lateral wall wherein said mobile linking device is positioned on said lateral wall of said shell base, wherein said boot further comprises a rear spoiler journaled on said shell base, wherein said tensioning means is positioned on said rear spoiler, wherein said first traction element is attached to said mobile linking device and to said tensioning means.

112. The boot defined by claim 111 wherein said foot comprises malleoli, wherein said rear spoiler is journaled on said shell base substantially at said malleoli, wherein said holding means comprises a support plate adapted to be positioned above said foot in said boot, wherein said second traction element engages the top of said support plate, wherein said support plate applies a force to said foot to hold said foot in said boot in response to tensioning of said second traction element, wherein said second portion of said boot comprises said front cuff, wherein said second traction element is at least partially wound on said at least one countershaft, wherein said first strand is attached to said shell base and said second strand is attached to said front cuff, wherein said boot further comprises means for adjusting the position of said mobile linking device, wherein said adjusting means is attached to at least one of said traction elements.

113. The boot defined by claim 7 wherein said boot further comprises a slipper positioned in said shell base, wherein said holding means further comprises a support plate having a shape corresponding substantially to the shape of the top of said foot, wherein said support plate is positioned in said shell base, between said shell base and said slipper, wherein said support plate engages said second traction element.

114. The boot defined by claim 7 wherein said first and second traction elements comprises first and second cables, respectively, wherein a portion of said first and second cables is encased in said boot.

115. An apparatus for use with means for closing the upper of a boot on the lower leg of a skier and for use with means for holding the foot of a skier in a boot, wherein said apparatus comprises:

a mobile linking device, adapted to be attached to said boot, wherein said mobile linking device links said closing means with said holding means, wherein said closing means comprises a first traction element, and wherein said holding means comprises a second traction element, and wherein said mobile linking device comprises means for changing the direction in which one of said first traction element and said second traction element extends.

116. The apparatus defined by claim 115, wherein said closing means further comprises means for tensioning said first traction element to close said upper, wherein said second traction element is arranged for applying a force to hold said foot in said boot, and wherein said mobile linking device comprises means for linking said first and second traction elements.

117. The apparatus defined by claim 116 wherein said boot comprises first and second portions, wherein at least one of said first and second portions is adapted to be displaced to close said upper on said lower leg of said skier, wherein said mobile linking device is adapted to be attached to said first portion of said boot, wherein said mobile linking device further comprises at least one countershaft, wherein one of said first and second traction elements is adapted to be partially wound around said at least one countershaft.

118. The apparatus defined by claim 117, wherein said mobile linking device comprises a plurality of countershafts.

119. The apparatus defined by claim 118, wherein said mobile linking device comprises two countershafts, said apparatus further comprising means for changing the distance between said two countershafts.

120. The apparatus defined by claim 119 wherein each countershaft comprises a threaded opening therein, wherein said changing means comprises a screw having a first threaded portion threaded in a first direction and a second threaded portion threaded in a direction opposite from said first direction, wherein said first and second threaded portions engage openings in different countershafts, whereby said two countershafts are displaced in opposite directions in response to rotation of said screw.

121. The apparatus defined by claim 117 wherein said closing means comprises a buckle and means for clamping said buckle, wherein said mobile linking device further comprises a plurality of teeth each adapted to engage said buckle, wherein said upper is closed in response to clamping said buckle when said buckle engages one of said teeth.

122. The apparatus defined by claim 117 wherein said mobile linking device further comprises means for attaching said first traction element to said mobile linking device at an attachment point, wherein said attaching means comprises means for adjusting the positioned said attachment point.

123. The apparatus defined by claim 123 in combination with said closing means, wherein said closing means comprises a tensioning lever, wherein said mobile linking device is attached to said tensioning lever.

124. The apparatus defined by claim 117 wherein said mobile linking device comprises means for translationally and slidingly engaging said boot.

125. The apparatus defined by claim 117 wherein said mobile linking device further comprises a plurality of spaced apart plugs each adapted to engage said first traction element, wherein said first traction element comprises a first end, a second end, and an intermediate portion between said first and second ends, wherein said first end has a diameter larger than said intermediate portion, wherein one of said plugs comprises an opening therein having a first portion and a second portion wherein said first portion of said opening is sufficiently large to accommodate said first end of said first traction element, wherein said second portion of said opening has a diameter smaller than said diameter of said first end of said first traction element and sufficient to accommodate passage of said intermediate portion of said first traction element.

126. The apparatus defined by claim 117 wherein said mobile linking element comprises means for rotatably engaging said boot.

127. An apparatus for closing the upper of a ski boot on a lower leg of a skier and for holding the foot of a skier in the shell base of said boot, wherein said apparatus comprises:

(a) means for closing said upper on the lower leg of the skier comprising a first traction element;

(b) means for holding the foot in the boot comprising a second traction element; and (c) means for linking said closing means and said holding means, wherein said linking means comprises means for changing the direction in which one of said first traction element and said second traction element extends.

128. The apparatus defined by claim 127 wherein said upper is journalled on said shell base, and wherein said closing means further comprises means for tensioning said first traction element wherein said first traction element closes said upper on said lower leg in response to tensioning of said first traction element by said tensioning means.

129. The apparatus defined by claim 128 wherein said first traction element at least partially surrounds the circumference of said upper, wherein said second traction element is arranged for applying a force to hold said foot in said boot, and wherein said linking means links said first and second traction elements.

130. The apparatus defined by claim 129 wherein said boot further comprises first and second portions wherein at least one of said first and portions is adapted to be displaced to closed said upper on said lower leg of said skier, wherein said linking means comprises a mobile linking device, wherein said mobile linking device is attached to said first portion of said boot, wherein said mobile linking device comprises:

(i) at least one countershaft around which one of said first and second traction elements is at least partially wound to define a loop comprising first and second strands, wherein said first strand is attached to said first portion of said boot and wherein said second strand is attached to said second portion of said boot.

131. The apparatus defined by claim 130 wherein said other of said first and second traction elements is attached to said mobile linking device and is operatively associated to said second portion of said boot.

132. The apparatus defined by claim 131 wherein at least one of said first and second portions of said boot is adapted to be displaced with respect to the other of said first and second portions so as to occupy open and closed position, wherein, in said open position said boot is adapted to receive said leg and said foot therein, wherein in said closed position said upper is closed on said lower leg of skier, wherein said holding means further comprises a support, adapted to be positioned on top of said foot, wherein said second traction element engages said support.

133. The apparatus defined by claim 132 wherein said tensioning means comprises a lever journaled on said upper.

134. The apparatus defined by claim 133 wherein said tensioning means further comprises a screw and a plug attached to said screw, wherein said first traction element is attached to said plug, wherein said screw is rotatably attached to said lever, wherein said plug and said traction element are displaced in response to rotation of said screw.

135. The apparatus defined by claim 131 wherein said first and second strands are attached to said first and second portions of said boot at first and second points of attachment, respectively, wherein said apparatus further comprises means for adjusting the positions of said first and second attachment points.

136. The apparatus defined by claim 135 further comprising means for adjusting the position of the other said traction of said members on said first and second portions of said boot, wherein said other of said traction members is attached to said first portion of said boot at a third attachment point and is attached to said second portion of said boot at a fourth attachment point, wherein said apparatus further comprises means for adjusting the position of said third and fourth attachment points.

137. The apparatus defined by claim 135, wherein said boot further comprises a lower portion wherein said holding means is adapted to be positioned in the general vicinity of said foot in the lower portion of said boot, wherein said holding means comprises a support plate, wherein said second traction means engages said support plate, wherein said support is positioned at substantially the vertical level of the top said foot, and wherein said mobile linking device comprises means for adjusting the position of said first and said second strands.

138. The apparatus defined by claim 135 wherein said mobile linking device is adapted to be translationally displaced on said boot, wherein at least one of said first and second traction means comprises means for translationally displacing said mobile linking device in at least one direction.

139. The apparatus defined by claim 135 wherein said mobile linking device is adapted to be rotationally displaced, wherein at least one of said first and second traction means comprises means for rotationally displacing said mobile linking device in at least one direction.

140. The apparatus defined by claim 130 wherein said mobile linking device further comprises a plurality of spaced apart countershafts, wherein said second traction element is adapted to be attached to one of said countershafts; and means for attaching said first traction element to said mobile linking device at an attachment point, wherein said attaching means comprises means for adjusting the position of said attachment point.

141. The apparatus defined by claim 7, wherein said first and second traction elements comprise cables.

142. The apparatus defined by claim 130, wherein said mobile linking device further comprises first and second countershafts, wherein each traction element is at least partially wound around the different countershaft.

143. The apparatus defined by claim 142, wherein said mobile linking device further comprises means for changing the distance between said two countershafts.

144. The apparatus defined by claim 130 wherein said mobile linking device further comprises a substantially circularly shaped element comprising first and second recesses, wherein said first traction element is adapted to engage said first recess and wherein said second traction element is adapted to engage said second recess.

145. The apparatus defined by claim 130, further comprising means for adjusting the position of said mobile linking device, wherein said adjusting means is attached to at least one of said traction elements.

146. The apparatus defined by claim 145 wherein said adjusting means preadjusts the position of said mobile linking device prior to tensioning of said tensioning means.

147. The apparatus defined by claim 146 wherein said adjusting means comprises a roller, wherein said second traction element is wound around said roller in response to rotation of said roller.

148. The apparatus defined by claim 130, wherein said closing means comprises means for generating a force symmetrical with respect to the longitudinal plane of symmetry of the boot to close the upper on the lower leg of the skier.

149. The apparatus defined by claim 130, wherein said apparatus comprises two mobile linking devices, wherein each mobile linking device is positioned on opposite lateral sides of said the upper of said boot.

150. The apparatus defined by claim 130 wherein said boot comprises a rear spoiler, wherein said mobile linking device is attached to said rear spoiler, wherein said apparatus further comprises a support plate, displaceable on said rear spoiler, wherein said support plate comprises a countershaft adapted to engage said second traction element, wherein said apparatus further comprises a cable, wherein said support plate and said mobile linking element are attached by said cable.

151. The apparatus defined by claim 130, wherein said boot comprises said spoiler, wherein said tensioning means is journaled on such spoiler, and wherein said apparatus further comprises adjustment means for adjusting the position of the ends of said first traction means, wherein said adjustment means comprises a roller positioned on said tensioning means.

152. The ski boot defined by claim 1 wherein said linking means further comprises means for actuating one of said closing and holding means in response to actuation of the other of said holding and closing means.

153. The apparatus defined by claim 115 wherein said mobile linking device further comprises means for actuating one of said holding means and said closing means in response to actuation of the other of said holding means and said closing means.

154. The apparatus defined by claim 127 wherein said linking means further comprises means for actuating one of said closing and holding means in response to actuation of the other of said holding and closing means.

155. A ski boot for holding the foot and the lower leg of a skier, wherein said ski boot comprises:

(a) an upper surrounding said lower leg of said skier, wherein said upper comprises a first and second portions, displaceable with respect to each other;

(b) a base for surrounding the foot of said skier;

(c) means for closing said upper on said lower leg of said skier;

(d) means for holding said foot in said boot;

(e) means for linking said closing and holding means wherein said linking means comprises means for actuating one of said closing and holding means in response to actuation of the other of said closing and holding means, wherein said closing means comprises a first traction element, wherein said holding means comprises a second traction element, wherein said linking means further comprises a mobile linking device, wherein said mobile linking device is attached to said first portion of said boot, wherein one of said two traction elements is fixably attached to said first portion of said boot at a distance from said mobile linking device.

156. An apparatus for closing the upper of a ski boot on the lower leg of a skier and for holding the foot of a skier in the shell base of said boot, wherein said apparatus comprises:

(a) means for closing said upper on said lower leg of said skier;

(b) means for holding the foot in said boot; and (c) means for linking said closing and holding means, wherein said linking means comprises a mobile linking device, wherein said boot comprises a first portion and a second portion which are displaceable with respect to each other to close and open the boot with respect to the lower leg of the skier, wherein said mobile linking device is attached to said first portion of said boot, wherein said closing means comprises a first traction element, wherein said holding means comprises a second traction element, wherein one of said first and second traction elements is fixably attached to said first portion of said boot at a distance from said mobile linking device.

157. The boot defined by claim 1 wherein said linking means further comprises a mobile linking device attached to said first portion of the boot, and supporting said at least one countershaft, wherein said mobile linking device is displaced in response to displacement of either said closing means or said holding means.

158. The apparatus defined by claims 115 wherein said mobile linking device is automatically displaced in response to displacement of said closing means or said holding means.

159. The apparatus defined by claim 127 wherein said linking means further comprises a mobile linking device, wherein said mobile linking device supports said direction changing means, wherein said mobile linking device is automatically displaced in response to displacement of said closing or holding means.

160. The boot defined by claim 155 wherein said mobile linking device is automatically displaced in response to displacement of said first traction element or said second traction element.

161. The apparatus defined by claims 156 wherein said mobile linking device is automatically displaced in response to displacement of either said first traction element or said second traction element.

162. The ski boot defined by claim 1 wherein said linking means comprises means for transmitting a force applied on said holding means to said closing means and for transmitting a force on said holding means to said holding means, wherein said linking means further comprises means for changing the magnitude of said force transmitted to said means whose direction is changed by said countershaft.

163. The ski boot defined by claim 162 wherein said transmitted force is one half of said applied force.

164. The ski boot defined by claim 1 wherein said leg comprises a short perimeter of the heel and a perimeter of the lower leg, wherein said linking means comprises means for automatically compensating for variations in the short perimeter of the heel and variations in the perimeter of the lower leg of various skiers.

165. The ski boot defined by claim 115 wherein said mobile linking device comprises means for transmitting a force applied on said holding means to said closing means and for transmitting a force on said closing means to said holding means, wherein said mobile linking device further comprises means for changing the magnitude of said force transmitted to said means whose direction is changed by said countershaft.

166. The ski boot defined by claim 165 wherein said transmitted force is one half of said applied force.

167. The ski boot defined by claim 115 wherein said leg comprises a short perimeter of the heel and a perimeter of the lower leg, wherein said mobile linking device comprises means for automatically compensating for variations in the short perimeter of the heel and variations in the perimeter of the lower leg of various skiers.

168. The ski boot defined by claim 127 wherein said linking means comprises means for transmitting a force applied on said holding means to said closing means and for transmitting a force on said closing means to said holding means, wherein said linking means further comprises means for changing the magnitude of said force transmitted to said means whose direction is changed by said countershaft.

169. The ski boot defined by claim 168 wherein said transmitted force is one half of said applied force.

170. The ski boot defined by claim 127 wherein said leg comprises a short perimeter of the heel and a perimeter of the lower leg, wherein said linking means comprises means for automatically compensating for variations in the short perimeter of the heel and variations in the perimeter of the lower leg of various skiers.

171. The ski boot defined by claim 155 wherein said leg comprises a short perimeter of the heel and a perimeter of the lower leg, wherein said mobile linking device comprises means for automatically compensating for variations in the short perimeter of the heel and variations in the perimeter of the lower leg of various skiers.

172. The ski boot defined by claim 156 wherein said leg comprises a short perimeter of the heel and a perimeter of the lower leg, wherein said mobile linking device comprises means for automatically compensating for variations in the short perimeter of the heel and variations in the perimeter of the lower leg of various skiers.

173. The boot defined by claim 1 wherein said linking means is translationally mobile with respect to said boot.

174. The boot defined by claim 7 wherein said at least one of said first and second portions is translationally mobile with respect to said boot.

175. The apparatus defined by claim 115 wherein said mobile linking device is translationally mobile with respect to said boot.

176. The apparatus defined by claim 127 wherein said linking means is translationally mobile with respect to said boot.

177. The boot defined by claim 155 wherein said mobile linking device is translationally mobile with respect to said boot.

178. The apparatus defined by claim 156 wherein said mobile linking device is translationally mobile with respect to said boot.

179. The boot defined by claim 8 wherein said first portion of said boot comprises a front cuff and said second portion of said boot comprises a rear spoiler, wherein said other of said first and second traction elements extends from said mobile linking device, extends across said rear spoiler, and is attached to said front cuff.

180. The boot defined by claim 131 wherein said first portion of said boot comprises a front cuff and said second portion of said boot comprises a rear spoiler, wherein said other of said first and second traction elements extends from said mobile linking device, extends across said rear spoiler, and is attached to said front cuff.

* * * * *